US010464764B2

(12) United States Patent
Yokawa

(10) Patent No.: US 10,464,764 B2
(45) Date of Patent: Nov. 5, 2019

(54) PAPER SHEET STORING/FEEDING DEVICE

(71) Applicant: GLORY LTD., Himeji-shi, Hyogo (JP)

(72) Inventor: Takeshi Yokawa, Himeji (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 15/758,978

(22) PCT Filed: Sep. 11, 2015

(86) PCT No.: PCT/JP2015/075865
§ 371 (c)(1),
(2) Date: Mar. 9, 2018

(87) PCT Pub. No.: WO2017/042965
PCT Pub. Date: Mar. 16, 2017

(65) Prior Publication Data
US 2018/0257884 A1 Sep. 13, 2018

(51) Int. Cl.
*B65H 5/36* (2006.01)
*B65H 5/00* (2006.01)
(Continued)

(52) U.S. Cl.
CPC ..... *B65H 5/00* (2013.01); *B65H 5/36* (2013.01); *B65H 29/006* (2013.01); *G07D 11/175* (2019.01); *B65H 2301/4191* (2013.01); *B65H 2301/41912* (2013.01); *B65H 2701/1912* (2013.01)

(58) Field of Classification Search
CPC ..... B65H 29/008; B65H 5/36; G07D 11/175
See application file for complete search history.

(56) References Cited

U.S. PATENT DOCUMENTS 4,822,018 A * 4/1989 Hain ..... B65H 29/51 271/3.2
6,565,082 B2 * 5/2003 Sasaki ..... B65H 5/28 271/216
(Continued)

FOREIGN PATENT DOCUMENTS

CN 1239363 C 2/2006
JP 2008-123093 A 5/2008
(Continued)

OTHER PUBLICATIONS

Written Opinion of the International Searching Authority (International Application No. PCT/JP2015/075865) (6 pages—dated Oct. 20, 2015).
(Continued)

*Primary Examiner* — Patrick H Mackey
(74) *Attorney, Agent, or Firm* — Renner Kenner Greive Bobak Taylor and Weber; Tim Hodgkiss; Edward Greive

(57) ABSTRACT

A paper sheet storing/feeding device (e.g., escrow unit 40) includes a rotary member (e.g., drum 42) to an outer peripheral surface of which one end of a belt-shaped winding member (e.g., tapes 90, 92, 94) that winds a plurality of paper sheets one by one is connected, and a guiding unit (80, 85) that guides a paper sheet to prevent the paper sheet from sandwiching the winding member from both sides when the paper sheet is fed from the rotary member by unwinding the winding member from the rotary member.

13 Claims, 27 Drawing Sheets

(51) Int. Cl.
*G07D 11/175* (2019.01)
*B65H 29/00* (2006.01)

(56) References Cited

U.S. PATENT DOCUMENTS 6,585,098 B2 * 7/2003 Satou ..... B65H 29/006 194/206
7,490,823 B2 * 2/2009 Oishi ..... B65H 5/28 242/528
8,360,223 B2 * 1/2013 Iwatsuki ..... B65H 29/006 194/206
8,544,845 B2 * 10/2013 Okamoto ..... B65H 5/28 271/275
8,725,297 B2 * 5/2014 Oishi ..... B65H 29/006 194/203
8,915,346 B2 * 12/2014 Petermann ..... G07F 19/202 194/206
9,092,926 B2 * 7/2015 Iwatsuki ..... B65H 29/006
9,595,153 B2 * 3/2017 Togiya ..... B65H 29/006
2002/0096816 A1 7/2002 Sasaki et al.
2009/0108115 A1 * 4/2009 Iwatsuki ..... B65H 29/006 242/370
2011/0084444 A1 4/2011 Okamoto
2014/0116839 A1 5/2014 Iwatsuki et al.

FOREIGN PATENT DOCUMENTS

JP 2008-171451 A 7/2008
JP 2013-61782 A 4/2013

OTHER PUBLICATIONS

Japanese Office Action with English Translation (Application No. 2014-154155) (16 pages—dated Feb. 22, 2018).
EPO, Supplementary European Search Report, EP Application No. 15 903 627.6, dated Apr. 3, 2019, 8 pages (EP counterpart to U.S. Appl. No. 15/758,978.
SIPO, Office Action dated Jul. 1, 2019, Chinese Patent Application No. 201580082906.5, 15 pages (9 pages + 6 pages for English translation) (Chinese counterpart to U.S. Appl. No. 15/758,978).

* cited by examiner

PAPER SHEET STORING/FEEDING DEVICE

TECHNICAL FIELD

The present invention relates to a paper sheet storing/feeding device capable of storing paper sheets such as banknotes one by one on a rotary member such as a drum, and feeding the paper sheet one by one from the rotary member.

BACKGROUND ART

As a banknote depositing and dispensing machine used in an automatic cash transaction apparatus such as an ATM (automatic teller machine) installed in a financial institution and the like, for example, the one disclosed in Japanese Patent Application Laid-Open No. 2008-171451 and the like is known in the art. In the conventional banknote depositing and dispensing machine disclosed in Japanese Patent Application Laid-Open No. 2008-171451 and the like, the banknotes inserted by a customer from a money deposition/dispensing port are fed one by one inside a body of the machine, and recognition of a denomination, authenticity, and the like of the banknote is performed in a banknote recognition unit. Moreover, the banknotes whose denomination and authenticity are confirmed are stored in an escrow unit, and, on the other hand, the banknotes that cannot be deposited are returned to the user. Then, after the transaction is established, the banknotes stored in the escrow unit are fed from the escrow unit and are stored in banknote storing and feeding units according to the denomination of the banknote. In such a banknote depositing and dispensing machine, a tape-type device is used as the escrow unit. In the tape-type device, one end of a belt-shaped tape is connected to an outer peripheral surface of a drum, and banknotes are wound one by one on the drum along with the tape.

In the conventional banknote depositing and dispensing machine disclosed in Japanese Patent Application Laid-Open No. 2008-171451 and the like, when the banknote inserted by the customer in the money deposition/dispensing port is in a bad condition and an edge of the banknote wound on the drum along with the belt-shaped tape in the escrow unit is cut, when feeding such a banknote from the drum, the banknote before being released from the tape may get folded at the cut portion and may sandwich the belt-shaped tape from both sides. When this happens, at an exit of the escrow unit, the part of the banknote that is folded inside and sandwiches the tape may be caught between the tape and a guiding roller, and the banknote may get torn at the cut part or an orientation of the banknote may change greatly. When this happens, that banknote is stuck at the exit of the escrow unit, and the banknote depositing and dispensing machine may stop.

SUMMARY OF INVENTION

The present invention has been made in view of the above discussion. One object of the present invention is to provide a paper sheet storing/feeding device in which, even if a paper sheet gets folded while the paper sheet is fed from a rotary member, because it is prevented by a guiding unit that the folded paper sheet sandwiches a winding member from both sides, it is possible to prevent that the paper sheet gets torn or an orientation of the paper sheet changes greatly near a place where the paper sheet is released from the winding member.

A paper sheet storing/feeding device of the present invention is a paper sheet storing/feeding device including: a rotary member to an outer peripheral surface of which one end of a belt-shaped winding member that winds a plurality of paper sheets one by one is connected, and on which the paper sheets are stored when the winding member is wound on the outer peripheral surface thereof and the paper sheets are fed therefrom when the winding member is unwound from the outer peripheral surface thereof; and a guiding unit that guides a paper sheet to prevent the paper sheet from sandwiching the winding member from both sides when the paper sheet is fed from the rotary member by unwinding the winding member from the rotary member.

According to the paper sheet storing/feeding device, the guiding unit is arranged to guide the paper sheet to prevent the paper sheet from sandwiching the winding member from both sides when the paper sheet is fed from the rotary member by unwinding the winding member from the rotary member. Because such guiding unit is arranged, when the paper sheet gets folded as the paper sheet is fed from the rotary member, it is prevented by the guiding unit that the folded paper sheet sandwiches the winding member from both sides. Therefore, it is prevented that the paper sheet gets torn or the orientation of the paper sheet changes greatly near the place (specifically, near the guiding roller that guides the winding member) where the paper sheet is released from the winding member.

In the paper sheet storing/feeding device of the present invention, the guiding unit may be arranged at a position in an axial direction of the rotary member to be facing the winding member.

In this case, the guiding unit may have a shape such that a folded part of the paper sheet moves away from the winding member in the axial direction of the rotary member when the paper sheet is fed from the rotary member by unwinding the winding member from the rotary member.

Moreover, the guiding unit may have a shape such that a width thereof in the axial direction of the rotary member gradually increases in a direction in which the paper sheet is fed from the rotary member.

In the paper sheet storing/feeding device of the present invention, the guiding unit may have a shape such that both sides thereof circumferentially extend along the rotary member with a constant width in the axial direction of the rotary member in the direction in which the paper sheet is fed from the rotary member.

In the paper sheet storing/feeding device of the present invention, the guiding unit may be arranged on each of two sides of the belt-shaped winding member and opposite to each other.

Further, the winding member may comprise a plurality of winding members arranged side by side along the axial direction of the rotary member, and the guiding unit may comprise a plurality of guiding units corresponding to each of the winding members.

The paper sheet storing/feeding device of the present invention may further include an additional guiding unit that is pivotable around an axis depending on a quantity of the paper sheets stored on the rotary member, and that may be guide the paper sheet when the paper sheet is stored on the rotary member by the winding of the winding member on the rotary member, and the guiding unit may be attached to the additional guiding unit.

In this case, the guiding unit may be arranged so as to bend towards the rotary member from a guide surface of the additional guiding unit that guides the paper sheet.

In the paper sheet storing/feeding device of the present invention, the guiding unit may be pivotable around an axis depending on a quantity of the paper sheets stored on the rotary member so as to be able to contact the winding member wound on the rotary member.

The paper sheet storing/feeding device of the present invention may further include a winding member guiding unit that is arranged near a guiding roller that guides the winding member unwound from the rotary member and that contacts the winding member present between the rotary member and the guiding roller, and the winding member guiding unit may have a shape that attempts to prevent the paper sheet unwound from the rotary member from entering between the guiding roller and the winding member.

In this case, the winding member guiding unit may have a shape that attempts to prevent the paper sheet unwound from the rotary member from entering between the winding member guiding unit and the winding member.

Further, the winding member guiding unit may have a shape such that the winding member guiding unit covers at least one side edge of the winding member that contacts the winding member guiding unit.

In the paper sheet storing/feeding device of the present invention, the winding member guiding unit may have a shape such that a cross-section of the winding member changes from a linear shape when the winding member contacts the winding member guiding unit.

BRIEF DESCRIPTION OF DRAWINGS

FIG. 5 is a perspective view of a configuration of the escrow unit shown in FIG. 2 and the like.

FIG. 8 is a perspective view of a configuration of a drive system of the escrow unit shown in FIG. 2 and the like.

FIG. 10 is a perspective view of a configuration of a guiding unit arranged in the escrow unit shown in FIG. 5 and the like.

FIG. 12 is a perspective view of a configuration of a scraper member arranged in the escrow unit shown in FIG. 5 and the like.

FIG. 14 is a perspective view of another configuration of the scraper member arranged in the escrow unit shown in FIG. 5 and the like.

DESCRIPTION OF EMBODIMENT

Exemplary embodiments of the present invention are explained below with reference to the accompanying drawings. FIGS. 1 to 18B are views of a paper sheet handling machine and a paper sheet storing/feeding device (specifically, an escrow unit) arranged in this paper sheet handling machine according to the present embodiment.

Figure 1:
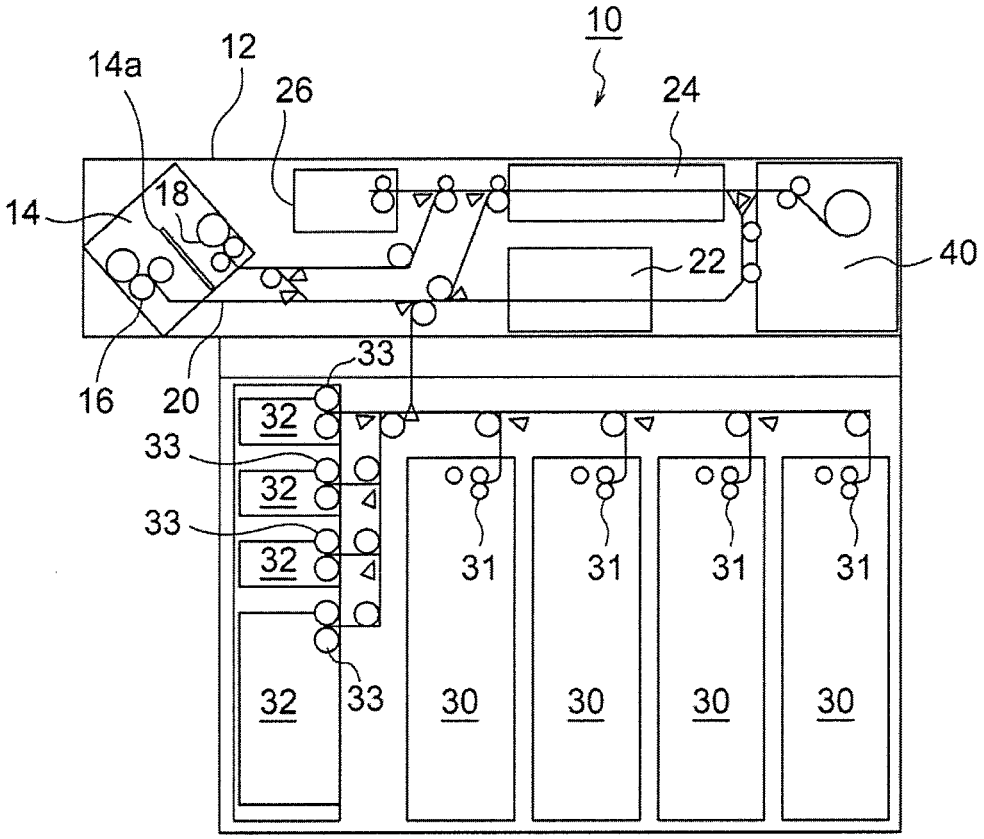
FIG. 1 is a structural diagram schematically showing an internal configuration of a paper sheet handling machine according to an embodiment of the present invention when the paper sheet handling machine is seen from a side.

At first, an overall configuration of a paper sheet handling machine 10 according to the present embodiment is explained by using FIG. 1. As shown in FIG. 1, the paper sheet handling machine 10 according to the present embodiment includes a housing 12 having a substantially rectangular parallelepiped shape. On a front surface (i.e., the left side in FIG. 1) of this housing 12 is arranged a money depositing/dispensing unit 14 for inserting from outside to inside of the housing 12 paper sheets such as banknotes, checks, bills, and ejecting the paper sheet from the inside to the outside of the housing 12. A first feeding mechanism 16 is arranged in the money depositing/dispensing unit 14. The first feeding mechanism 16 feeds inside the housing 12 a plurality of paper sheets one by one inserted in a stacked manner in the money depositing/dispensing unit 14. Moreover, a transport unit 20 that transports the paper sheets one by one is connected to the money depositing/dispensing unit 14. The paper sheets fed by the first feeding mechanism 16 from the money depositing/dispensing unit 14 are transported one by one by the transport unit 20. Moreover, a second feeding mechanism 18, which is different from the first feeding mechanism 16, is arranged in the money depositing/dispensing unit 14. A paper sheet returned to the money depositing/dispensing unit 14 by the transport unit 20 can be fed back to the transport unit 20 by the second feeding mechanism 18. In the money depositing/dispensing unit 14 is arranged a partition member 14*a* capable of moving towards the first feeding mechanism 16 or away from the first feeding mechanism 16 (i.e., towards the second feeding mechanism 18). The money depositing/dispensing unit 14 is divided into two areas (specifically, an insertion opening on the first feeding mechanism 16 side and an ejection opening on the second feeding mechanism 18 side) by the partition member 14*a*. Moreover, a recognition unit 22 that recognizes the paper sheet transported by the transport unit 20 is arranged in the middle of the transport unit 20. Specifically, an image sensor is arranged in the recognition unit 22. Information such as an amount of money (denomination in the case of a banknote), authenticity, fitness, and the like of the paper sheet are acquired based on an image of a surface of the paper sheet acquired by the image sensor. A detailed configuration of the recognition unit 22 will be explained later.

As shown in FIG. 1, an escrow unit 40 is connected to the transport unit 20. The escrow unit 40 stores therein the paper sheets one by one sent from the transport unit 20 and feeds the stored paper sheets one by one to the transport unit 20. The paper sheet that is fed by the first feeding mechanism 16 from the money depositing/dispensing unit 14 to the transport unit 20 and recognized by the recognition unit 22 is sent to the escrow unit 40 by the transport unit 20, and is temporarily escrowed in the escrow unit 40. A detailed configuration of the escrow unit 40 will be explained later.

Moreover, a width-wise position aligning unit 24 is arranged in the transport unit 20. The width-wise position aligning unit 24 shifts the paper sheet transported by the transport unit 20 to a predetermined position such as a central position in a width direction of transport path. A position of the paper sheet fed from the escrow unit 40 to the transport unit 20 is shifted by the width-wise position aligning unit 24 to the predetermined position such as the central position in the width direction of the transport path.

Moreover, a counterfeit note storing unit 26 is connected to the transport unit 20. A banknote that is recognized as a counterfeit note by the recognition unit 22 and/or a banknote that is recognized as having an uncertain authenticity by the recognition unit 22 are stored in the counterfeit note storing unit 26.

In the present embodiment, a reject paper sheet that is recognized as not being a normal paper sheet by the recognition unit 22 can be returned to the money depositing/dispensing unit 14 (precisely, to the ejection opening towards the second feeding mechanism 18 side of the partition member 14*a*) by the transport unit 20. In this manner, because the money depositing/dispensing unit 14 has been divided into the insertion opening and the ejection opening by the partition member 14*a*, the paper sheet returned to the money depositing/dispensing unit 14 by the transport unit 20 is stacked at a different location from a location at which the paper sheet is stacked for feeding by the first feeding mechanism 16 to the transport unit 20.

Moreover, a plurality of paper sheet storing and feeding units 30 is connected to the transport unit 20. Each of the paper sheet storing and feeding units 30 can store therein in a stacked manner the paper sheets sent thereto from the transport unit 20. Moreover, a feeding mechanism 31 is arranged in each of the paper sheet storing and feeding units 30. The paper sheet stored in each of the paper sheet storing and feeding units 30 can be fed by the feeding mechanism 31 to the transport unit 20. These paper sheet storing and feeding units 30 are typically used for recycling. That is, as a recycling process of a paper sheet, when dispensing process of the paper sheet is executed, the paper sheet stored in one of the paper sheet storing and feeding units 30 is fed by the feeding mechanism 31 to the transport unit 20 and sent to the money depositing/dispensing unit 14 (precisely, to the ejection opening towards the second feeding mechanism 18 side of the partition member 14*a*).

Moreover, a plurality of paper sheet storing and feeding units 32 is connected to the transport unit 20. Each of the paper sheet storing and feeding units 32 can store therein in a stacked manner the paper sheets sent thereto from the transport unit 20. Moreover, a feeding mechanism 33 is arranged in each of the paper sheet storing and feeding units 32. The paper sheet stored in the paper sheet storing and feeding unit 32 can be fed by the feeding mechanism 33 to the transport unit 20. These paper sheet storing and feeding units 32 are typically used for money deposition.

A detailed configuration of the escrow unit 40 of the paper sheet handling machine 10 is explained below by using FIGS. 2 to 15. In the present embodiment, the escrow unit 40 is a tape-type paper sheet storing/feeding device that stores a plurality of paper sheets one by one on a drum 42 by winding on the drum 42 three belt-shaped tapes 90, 92, 94 arranged side-by-side, and that feeds the paper sheets one by one from the drum 42 by unwinding the tapes 90, 92, 94 from the drum 42.

Figure 2:
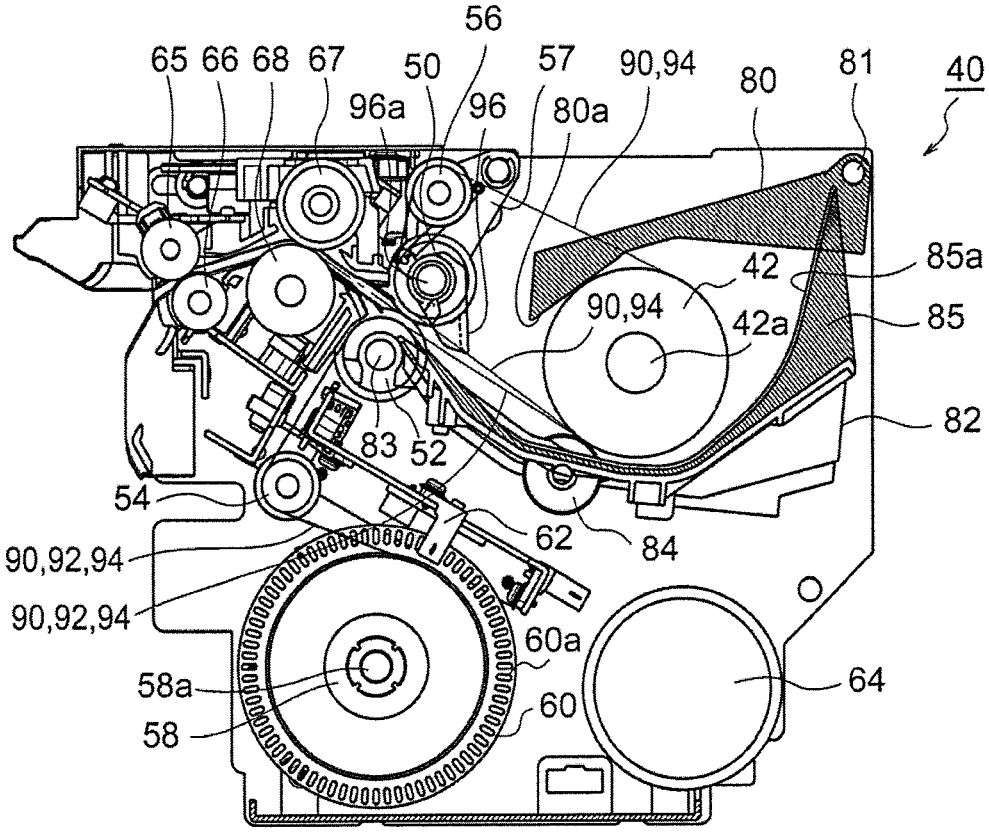
FIG. 2 is a side view of a detailed configuration of an escrow unit arranged in the paper sheet handling machine shown in FIG. 1.
Figure 3:
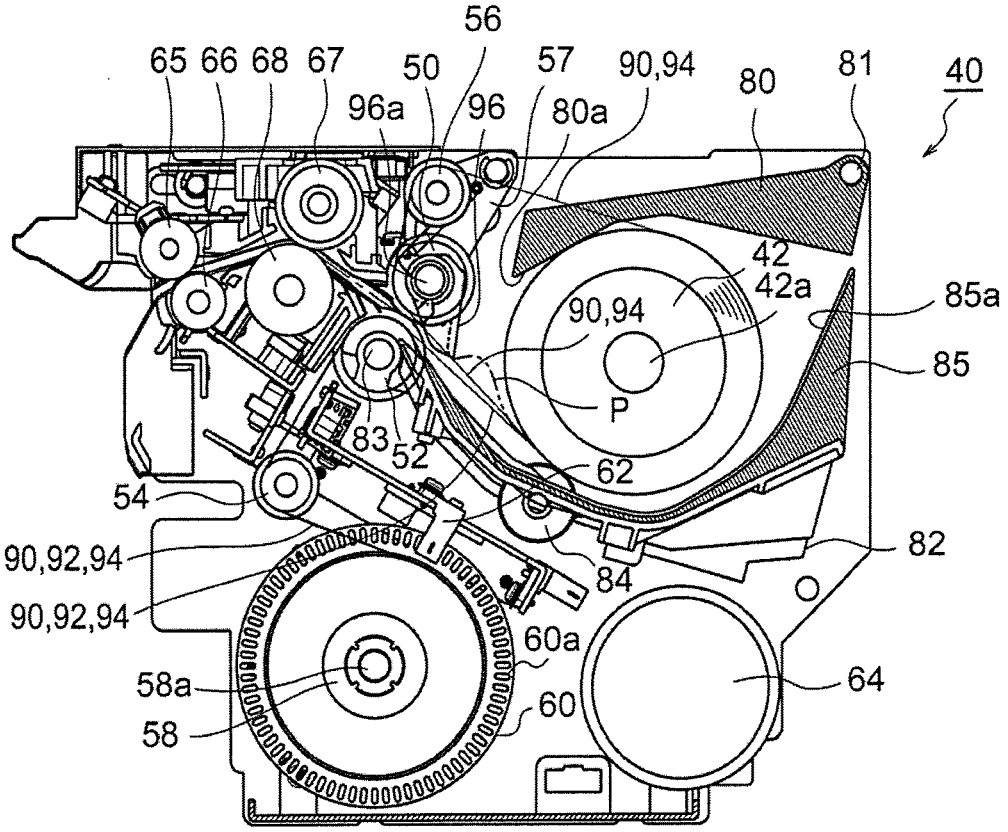
FIG. 3 is another side view of a detailed configuration of the escrow unit arranged in the paper sheet handling machine shown in FIG. 1.
Figure 4:
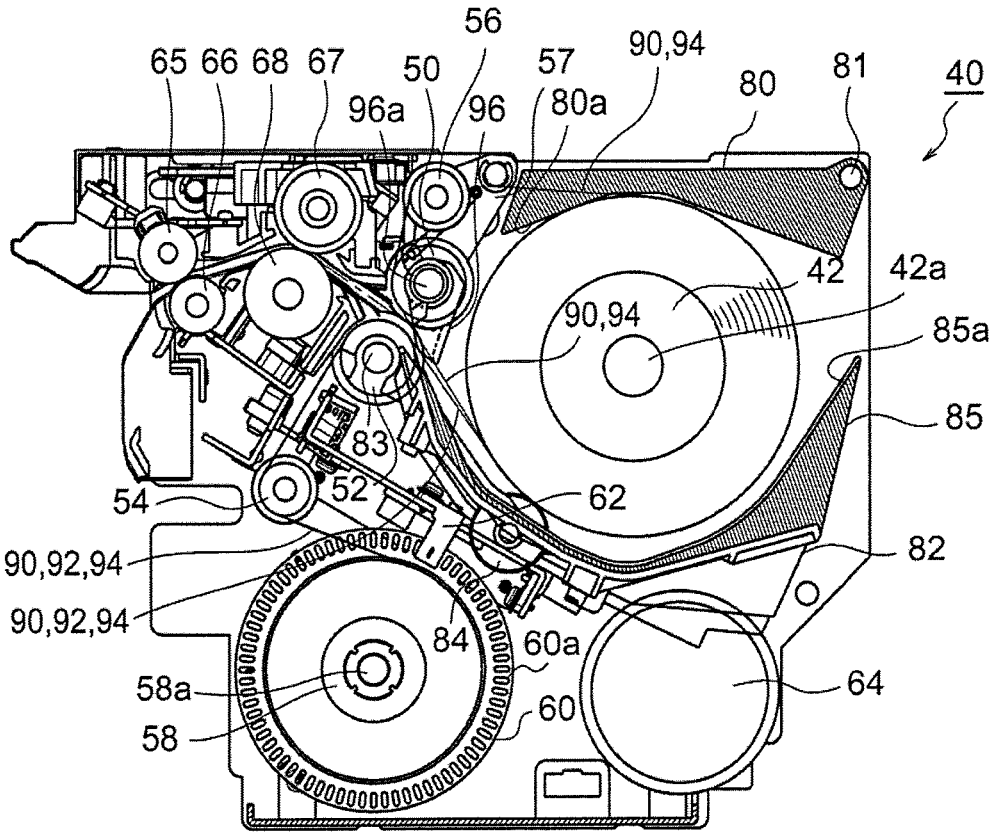
FIG. 4 is still another side view of a detailed configuration of the escrow unit arranged in the paper sheet handling machine shown in FIG. 1.
Figure 5:
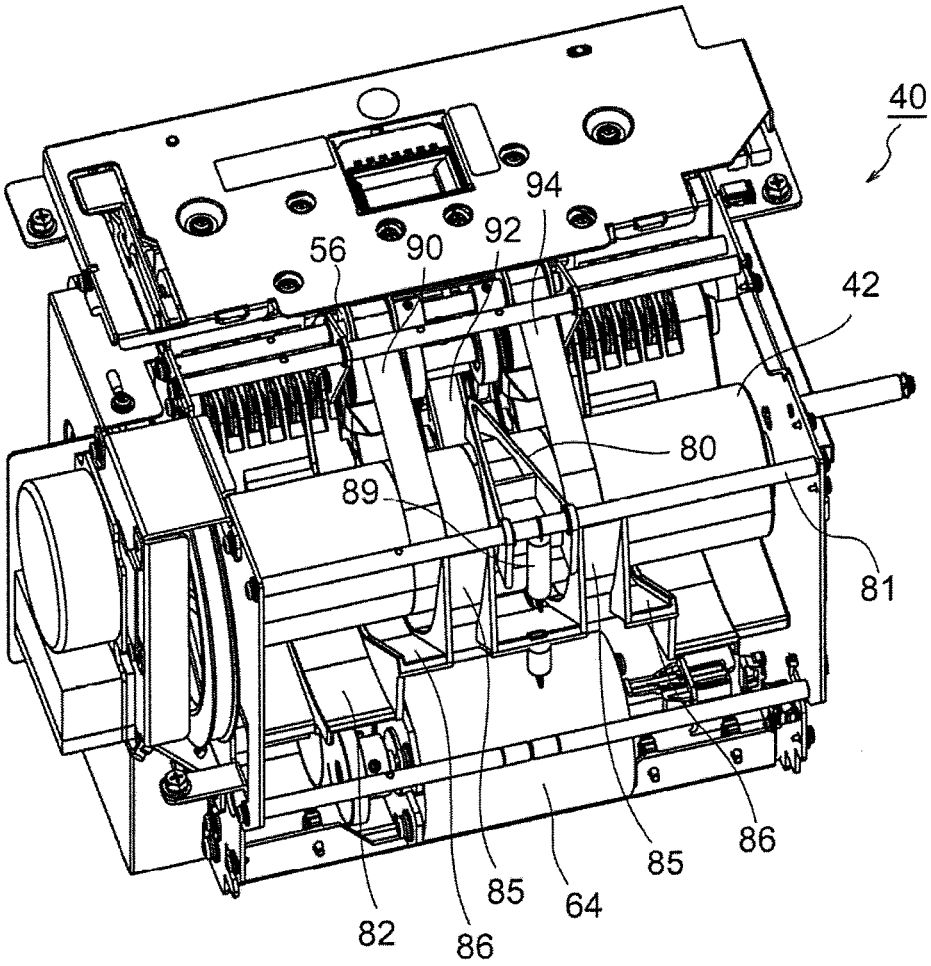
Figure 6:
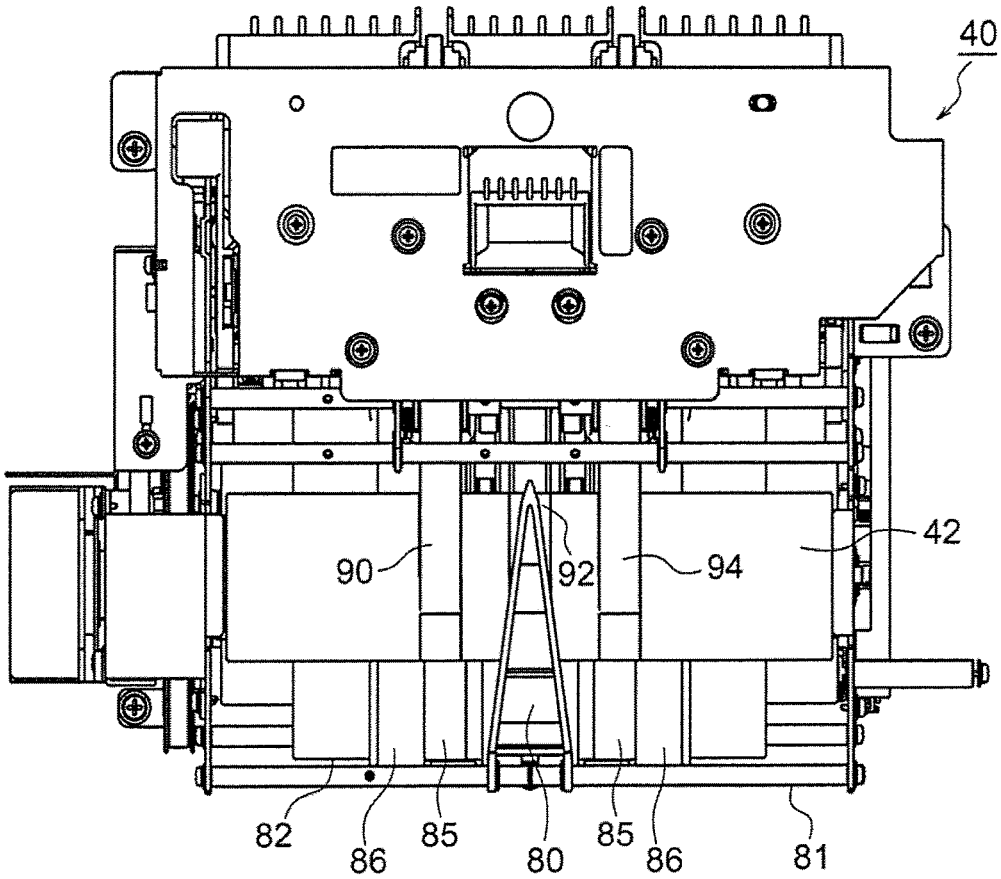
FIG. 6 is a top view of a configuration of the escrow unit shown in FIG. 5 when seen from above.
Figure 7:
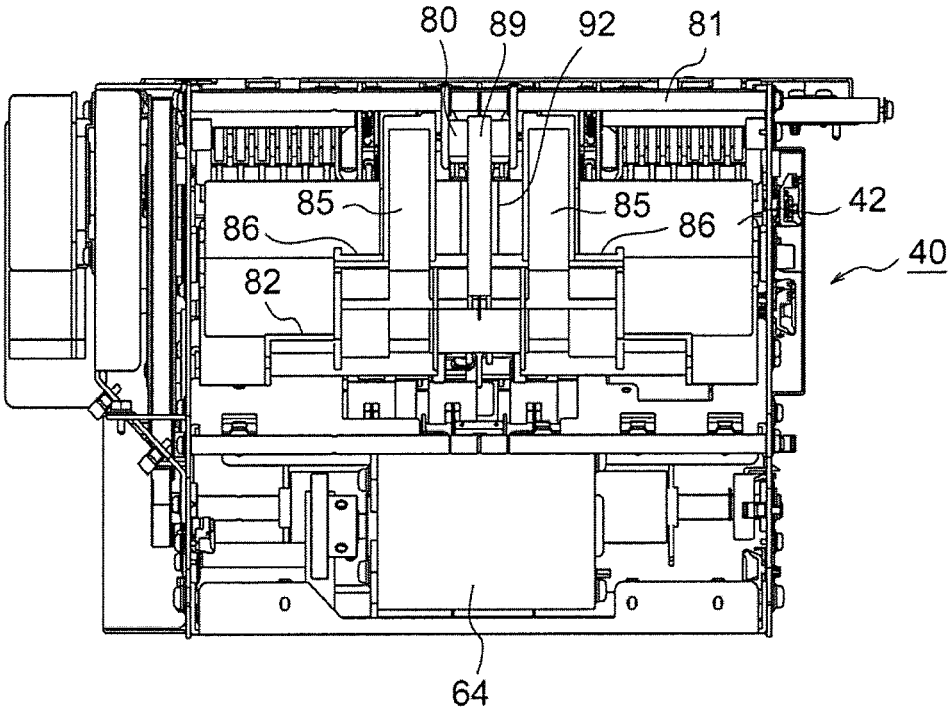
FIG. 7 is a front view of a configuration of the escrow unit shown in FIG. 5 when seen from front.
Figure 8:
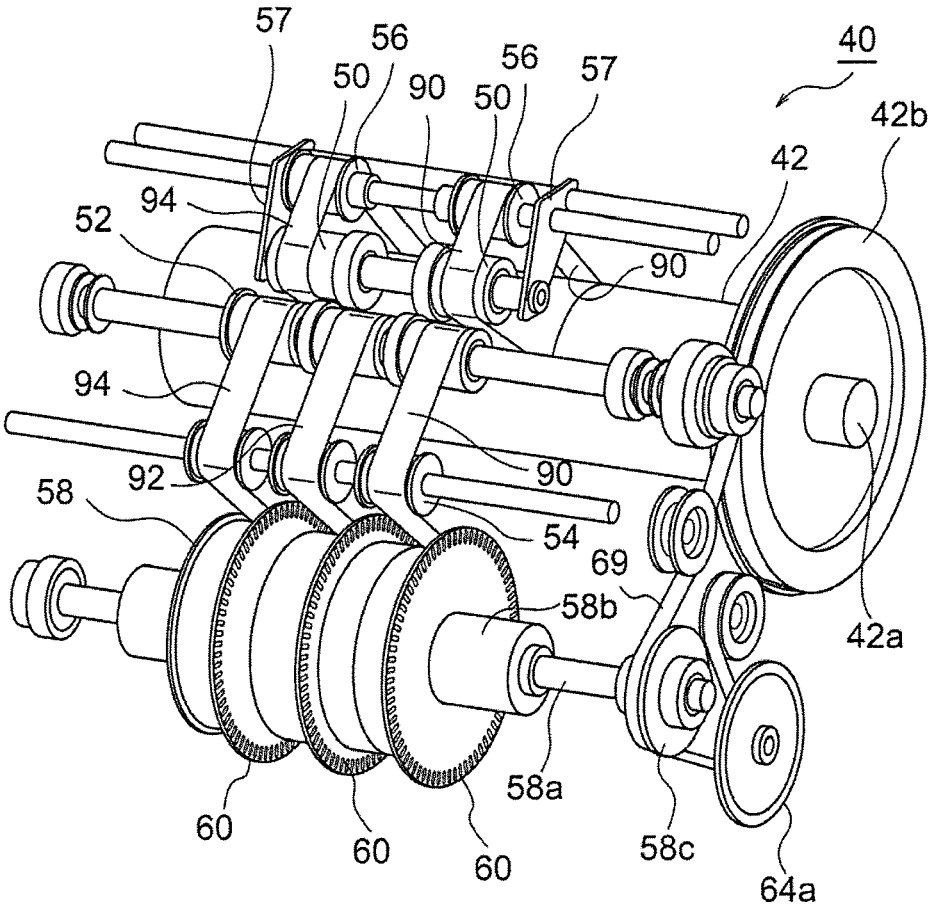
Figure 9A:
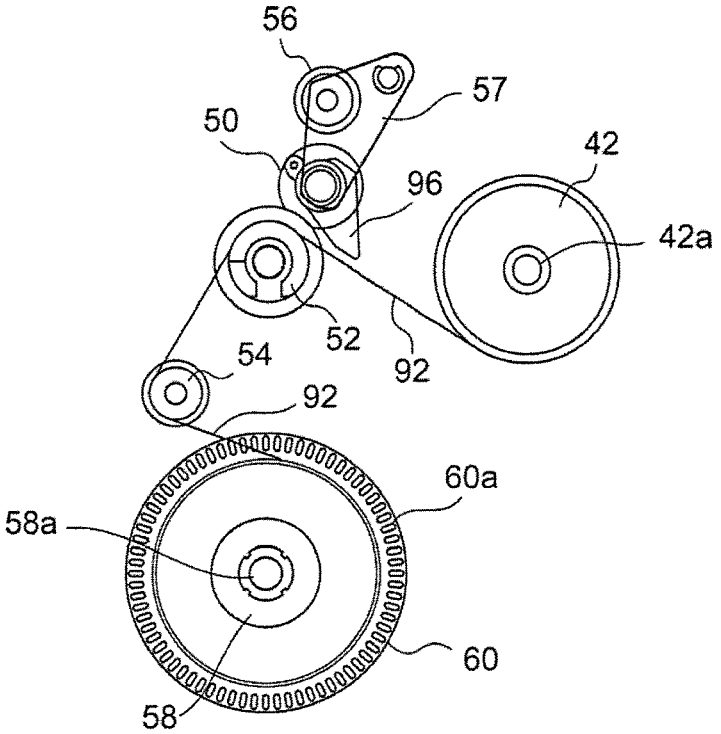
FIG. 9A is a side view showing a transportation path of a central tape among three tapes arranged in the escrow unit shown in FIG. 5.
Figure 9B:
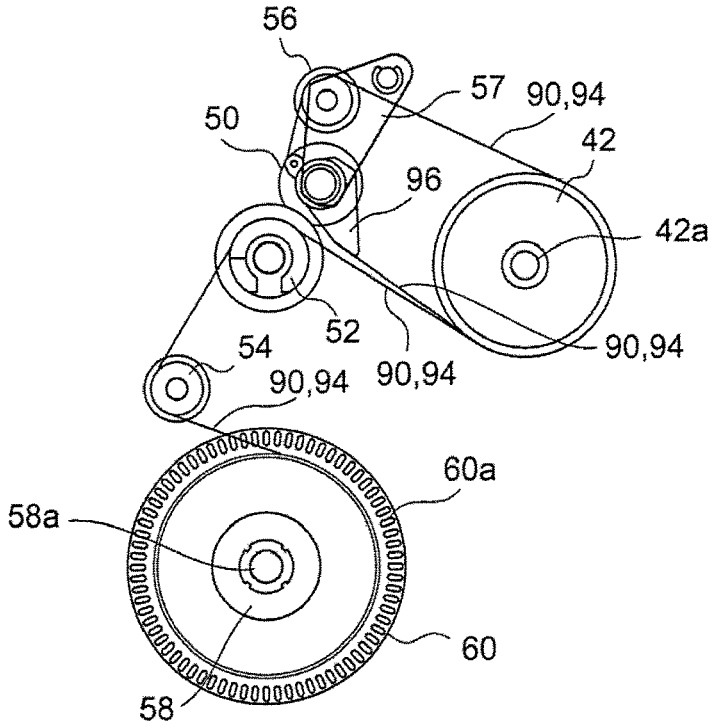
FIG. 9B is a side view showing a transportation path of side tapes among the three tapes arranged in the escrow unit shown in FIG. 5.

FIGS. 2 to 4 are side views of a detailed configuration of the escrow unit 40 arranged in the paper sheet handling machine 10 shown in FIG. 1. Note that, FIG. 2 is a view indicating a state in which no paper sheet is wound on the drum 42 of the escrow unit 40, FIG. 3 is a view indicating a state in which some paper sheets are wound on the drum 42 of the escrow unit 40 from the state shown in FIG. 2, and FIG. 4 is a view indicating a state in which still more paper sheets are wound on the drum 42 of the escrow unit 40 from the state shown in FIG. 3. FIG. 5 is a perspective view of a configuration of the escrow unit 40 shown in FIG. 2 and the like, FIG. 6 is a top view of a configuration of the escrow unit 40 shown in FIG. 5 when seen from above, and FIG. 7 is a front view of a configuration of the escrow unit 40 shown in FIG. 5 when seen from front. FIG. 8 is a perspective view of a configuration of a drive system of the escrow unit 40 shown in FIG. 2 and the like. FIG. 9A is a side view showing a transportation path of a central tape 92 among the three tapes 90, 92, 94 arranged in the escrow unit 40 shown in FIG. 5, and FIG. 9B is a side view showing a transportation path of side tapes 90 and 94 among the three tapes 90, 92, 94 arranged in the escrow unit 40 shown in FIG. 5.

As shown in FIGS. 2 to 8, the escrow unit 40 includes the rotatable drum 42, the three belt-shaped tapes 90, 92, 94 whose one ends are connected to an outer peripheral surface of the drum 42, and a rotatable tape reel 58 to an outer peripheral surface of which the other ends of the tapes 90, 92, 94 are connected. As shown in FIGS. 5 to 8, the tapes 90, 92, 94 are arranged side-by-side in a direction parallel to an axis 42*a* of the drum 42.

The drum 42 can rotate around the axis 42*a* in both a clockwise direction and a counterclockwise direction in FIGS. 2 to 4. Specifically, when storing on the drum 42 the paper sheet sent to the escrow unit 40 from the transport unit 20, the drum 42 rotates in the counterclockwise direction in FIGS. 2 to 4, so that the paper sheet sent near the drum 42 is wound on the drum 42 along with the tapes 90, 92, 94. On the other hand, when feeding the paper sheet stored on the drum 42 to the transport unit 20, the drum 42 rotates in the clockwise direction in FIGS. 2 to 4, so that the paper sheet is released from the tapes 90, 92, 94 because of unwinding of the tapes 90, 92, 94 from the drum 42, and the paper sheet is sent to the transport unit 20. Note that, in the present embodiment, in the escrow unit 40, the paper sheet is transported along a direction of a short edge of the paper sheet and wound on the drum 42.

Moreover, as shown in FIGS. 2 to 4, a drive motor 64 that rotationally drives the drum 42 is arranged in the escrow unit 40. More particularly, as shown in FIG. 8, a pulley 64*a* is connected to the drive motor 64 via a rotation axis, and a drive belt 69 is looped over the pulley 64*a*. Moreover, a pulley 42*b* is arranged on the axis 42*a* of the drum 42, and the drive belt 69 is looped over the pulley 42*b*. Accordingly, when the drive motor 64 rotationally drives the pulley 64*a*, the driving force of the drive motor 64 is conveyed to the axis 42*a* via the drive belt 69, and the drum 42 is rotationally driven.

As shown in FIGS. 2 to 4, guiding rollers 52 and 54 that guide the tapes 90, 92, 94 are arranged in the escrow unit 40. The tapes 90, 92, 94 are guided between the drum 42 and the tape reel 58 by these guiding rollers 52 and 54. Moreover, in addition to the guiding rollers 52 and 54, guiding rollers 50 and 56 that guide the side tapes 90 and 94 among the three tapes 90, 92, 94 are arranged in the escrow unit 40. The tapes 90 and 94 are guided by these guiding rollers 50 and 56. Moreover, as shown in FIGS. 2 to 4 and FIGS. 8 to 9B, substantially triangular support plates 57 that support axes of both the guiding roller 50 and the guiding roller 56 is arranged.

More particularly, as shown in FIG. 9A, the central tape 92 among the three tapes 90, 92, 94 is transported between the drum 42 and the tape reel 58 by the guiding rollers 52 and 54. When the drum 42 rotates in the counterclockwise direction in FIGS. 2 to 4, the tape 92 is unwound from the tape reel 58, sequentially passes from the guiding roller 54 to the guiding roller 52, and is finally wound on the drum 42. Moreover, when the tape reel 58 rotates in the clockwise direction in FIGS. 2 to 4, the tape 92 is unwound from the drum 42, sequentially passes from the guiding roller 52 to the guiding roller 54, and is finally wound on the tape reel 58. Moreover, as shown in FIG. 9B, the side tapes 90 and 94 among the three tapes 90, 92, 94 are transported between the drum 42 and the tape reel 58 by the guiding rollers 52 and 54. Moreover, the side tapes 90 and 94 are transported near the drum 42 by the guiding rollers 50 and 56. When the drum 42 rotates in the counterclockwise direction in FIGS. 2 to 4, the tapes 90 and 94 are unwound from the tape reel 58, sequentially pass from the guiding rollers 54 to the guiding rollers 52, and are wound on the drum 42 for approximately half a turn of the drum 42. Then, the tapes 90 and 94 further sequentially pass from the guiding rollers 56 to the guiding rollers 50 and are wound on the drum 42. Accordingly, when the paper sheet sent from the transport unit 20 to the escrow unit 40 passes between the guiding rollers 50 and 52, this paper sheet is sandwiched between a pair of the tapes 90 and a pair of the tapes 94, and the paper sheet is wound on the drum 42 along with the tapes 90 and 94 while being sandwiched between the pair of the tapes 90 and the pair of the tapes 94. Moreover, when the tape reel 58 rotates in the clockwise direction in FIGS. 2 to 4, the tapes 90 and 94 are unwound from the drum 42, sequentially pass from the guiding rollers 50 to the guiding rollers 56, and are wound on the drum 42 for approximately half a turn of the drum 42. Then, the tapes 90 and 94 further sequentially pass from the guiding rollers 52 to the guiding rollers 54 and are wound on the tape reel 58.

Moreover, as shown in FIGS. 2 to 4, detecting plates 60 that rotate in synchronization with the tape reel 58 are attached to the tape reel 58. Note that, as shown in FIG. 8, the detecting plates 60 are arranged in a number (specifically, for example, three) equal to the number of the tapes 90, 92, 94. Moreover, a photointerrupter 62 is arranged near each of the detecting plates 60. The photointerrupter 62 functions as a detecting plate rotation amount detector that detects an amount of rotation of the corresponding detecting plate 60. More particularly, a plurality of through-holes 60*a* is formed in the detecting plate 60, and the photointerrupter 62 includes a light emitting element and a light receiving element arranged across an outer circumferential edge of the detecting plate 60. When the detecting plate 60 rotates, an optical axis between the light emitting element and the light receiving element of the photointerrupter 62 intermittently becomes continuous because of the through-holes 60*a* arranged in the detecting plate 60. In this manner, the state of the photointerrupter 62 repeatedly switches between a light transmissive state and a light interruptive state as the detecting plate 60 rotates. The photointerrupter 62 detects the amount of rotation of the detecting plate 60 based on the number of times (pulse number) of the switching between the light transmissive state and the light interruptive state.

Moreover, as shown in FIG. 8, a torque limiter 58*b* is arranged corresponding to each of the detecting plates 60 on a side surface of each of the detecting plates 60. Note that, only one torque limiter 58*b* is shown in FIG. 8 but actually three torque limiters 58*b* are arranged each corresponding to each of the three detecting plates 60. Moreover, an inner part of the torque limiter 58*b* is fixed to an axis 58*a* by a not-shown pin and the like so that the inner part of the torque limiter 58*b* rotates integrally with the axis 58*a*. On the other hand, an outer part of the torque limiter 58*b* is fixed to the side surface of the detecting plate 60 so that the outer part of the torque limiter 58*b* rotates integrally with the detecting plate 60 and the tape reel 58. Moreover, the detecting plate 60 and the tape reel 58 are rotatable with respect to the axis 58*a*. In the torque limiter 58*b*, when an external force (rotation driving force) applied to the inner part and the outer part of the torque limiter 58*b* is lower than a rotation resistance between the inner part and the outer part, the inner part and the outer part of the torque limiter 58*b* rotate integrally. However, when the external force is higher than the rotation resistance between the inner part and the outer part of the torque limiter 58*b*, the inner part and the outer part rotate while skidding with each other by a rotation resistance of a certain load. Moreover, a pulley 58*c* on which is looped the drive belt 69 is connected to the axis 58*a*. A not-shown one way clutch is built in the pulley 58*c*.

When the drive motor 64 rotationally drives the pulley 64*a* to rotate the drive belt 69 such that the tapes 90, 92, 94 are wound on the drum 42, the driving force of the drive belt 69 is not conveyed to the axis 58*a* because of the one way clutch built-in the pulley 58*c*, and the axis 58*a* does not rotate. In this case, because the drum 42 rotates in the counterclockwise direction in FIGS. 2 to 4, the tapes 90, 92, 94 are wound on the drum 42, and the tape reel 58 also rotates in the counterclockwise direction in FIGS. 2 to 4 because of the winding operation of the tapes 90, 92, 94. In this case, however, because the external force (rotation driving force) applied to the outer part of the torque limiter 58*b* is higher than the rotation resistance between the inner part and the outer part of the torque limiter 58*b*, the outer part of the torque limiter 58*b* rotates while skidding with respect to the inner part by the rotation resistance of the certain load. On the other hand, when the drive motor 64 rotationally drives the pulley 64*a* to rotate the drive belt 69 such that the tapes 90, 92, 94 are wound on the tape reel 58, the driving force of the drive belt 69 is conveyed to the axis 58*a*. Because the rotation driving force is conveyed to the tape reel 58 via the torque limiter 58*b*, the tape reel 58 is rotationally driven. In this case, the tapes 90, 92, 94 are unwound from the drum 42 because of the rotation of the tape reel 58 in the clockwise direction in FIGS. 2 to 4, and the drum 42 is also rotated in the clockwise direction in FIGS. 2 to 4 because of such unwinding operation of the tapes 90, 92, 94. However, by setting a gear ratio of the pulleys 42*b* and 58*c* so that a winding speed of the tapes 90, 92, 94 wound on the tape reel 58 is always higher than an unwinding speed of the tapes 90, 92, 94 unwound from the drum 42, a tension on each of the tapes 90, 92, 94 can be maintained. In this case, because the external force (rotation driving force) applied to the inner part of the torque limiter 58*b* is higher than the rotation resistance between the inner part and the outer part of the torque limiter 58*b*, the inner part of the torque limiter 58*b* rotates while skidding with respect to the outer part by the rotation resistance of the certain load.

Moreover, as shown in FIGS. 2 to 4, guiding rollers 65, 66, 67, 68 that guide to the drum 42 the paper sheet sent to the escrow unit 40 from the transport unit 20, and guide the paper sheet fed from the drum 42 to the transport unit 20 are arranged in the escrow unit 40. More particularly, a pair of the guiding rollers 65 and 66 is arranged opposite to each other such that their outer peripheral surfaces touch with each other. Moreover, a pair of the guiding rollers 67 and 68 is arranged opposite to each other such that their outer peripheral surfaces touch with each other. The paper sheet sent from the transport unit 20 to the escrow unit 40 first passes between the guiding rollers 65 and 66, next passes between the guiding rollers 67 and 68, and is finally wound on the drum 42 by the tapes 90, 92, 94. Moreover, when the drum 42 rotates in the clockwise direction in FIGS. 2 to 4, because the tapes 90, 92, 94 are unwound from the drum 42, the paper sheet is released from the tapes 90, 92, 94. The released paper sheet first passes between the guiding rollers 67 and 68, next passes between the guiding rollers 65 and 66, and is finally sent to the transport unit 20.

Moreover, as shown in FIGS. 2 to 4, the escrow unit 40 is provided with a movable guide 82 in a periphery of the drum 42 so as to surround the tapes 90, 92, 94 wound on the drum 42. The movable guide 82 rotates around an axis 83 that is arranged coaxially with an axis of the guiding roller 52. Moreover, a biasing unit such as a spring 89 (see FIG. 7) that biases the movable guide 82 in the counterclockwise direction in FIGS. 2 to 4 around the axis 83 is arranged. Moreover, the movable guide 82 is provided with a bearing 84 that pushes the paper sheet wound on the drum 42 towards the axis 42*a* of the drum 42. Because the movable guide 82 is biased in the counterclockwise direction in FIGS. 2 to 4 around the axis 83 by the biasing unit such as the spring 89, the bearing 84 is pushed in the upper direction in FIGS. 2 to 4, and the paper sheet wound on the drum 42 is pushed towards the axis 42*a* of the drum 42 by the bearing 84. Moreover, because the movable guide 82 is biased in the counterclockwise direction in FIGS. 2 to 4 around the axis 83 by the biasing unit such as the spring 89, even if the outer diameter of the tapes 90, 92, 94 decreases because the paper sheets wound on the drum 42 are unwound from the drum 42, the bearing 84 always touches the paper sheet and pushes the paper sheet.

In the present embodiment, even if the paper sheet gets folded while the paper sheet is fed from the drum 42 when the drum 42 rotates in the clockwise direction in FIGS. 2 to 4, guiding units 80 and 85 are arranged to prevent the folded paper sheet from sandwiching the tapes 90, 92, 94 from both sides. As mentioned above, in the present embodiment, the tapes 90, 92, 94 are arranged side-by-side in the direction parallel to the axis of the drum 42. The guiding units 80 and 85 are arranged corresponding to each of the tapes 90, 92, 94. These guiding units 80 and 85 are shown with hatching in FIGS. 2 to 4.

Even if the paper sheet gets folded while the paper sheet is fed from the drum 42, the guiding unit 80 prevents the folded paper sheet from sandwiching the central tape 92 from both sides. The guiding unit 80 is installed above the drum 42, and it is rotatable around an axis 81 that is parallel to the axis 42*a* of the drum 42. A tip part of the guiding unit 80 touches the tape 92 wound on the drum 42 by the weight of the guiding unit 80. Note that, instead of the tip part of the guiding unit 80 touching the tape 92 wound on the drum 42 by the weight of the guiding unit 80, it is allowable that the tip part of the guiding unit 80 is biased towards the drum 42 by a not-shown biasing unit such as a spring. As shown in FIGS. 5 and 6, a position of the guiding unit 80 in the axial direction of the drum 42 (i.e., a position in the left-right direction of FIG. 6) is opposite to the tape 92.

A shape of the guiding unit 80 is such that a folded part of the paper sheet moves away from the tape 92 in the axial direction of the drum 42 when the paper sheet is fed from the drum 42 as the tapes 90, 92, 94 are unwound from the drum 42. Specifically, when the escrow unit 40 is seen from above, as shown in FIG. 6, the guiding unit 80 has a triangular shape such that a width thereof in the axial direction of the drum 42 (i.e., a width in the left-right direction of FIG. 6) gradually increases in a direction in which the paper sheet is fed from the drum 42 (i.e., in a lower direction in FIG. 6). That is, the guiding unit 80 becomes wider on outer sides in a width direction of the tape 92 as it goes away from the drum 42 in the direction in which the paper sheet is fed. Because the guiding unit 80 having such a configuration is arranged opposite to the tape 92 so as to be in contact with the surface of the tape 92, even if a folded part of the paper sheet tries to ride on the surface of the tape 92 when the paper sheet is fed from the drum 42 as the tapes 90, 92, 94 are unwound from the drum 42, it is inhibited that the folded part rides on the surface of the tape 92 as the folded part of this paper sheet contacts the side of the guiding unit 80. Therefore, it is prevented that the folded paper sheet sandwiches the tape 92 from both sides.

Figure 18A:
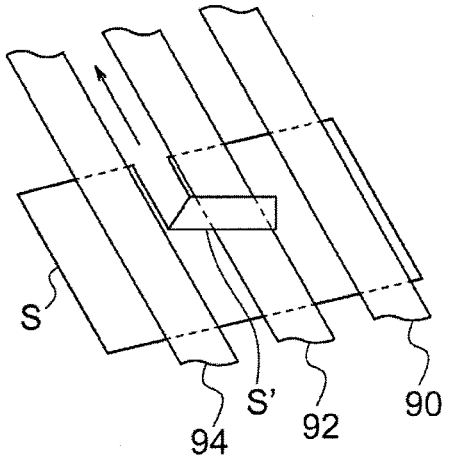
FIGS. 18A and 18B show states in which an edge of a banknote wound on a drum along with the belt-shaped tape in the escrow unit of the paper sheet handling machine shown in FIG. 1 is cut, and the banknote being released from the tape gets folded at the cut part and sandwiches the belt-shaped tape from both sides.

In other words, if it is assumed that the guiding unit 80 is not arranged in the escrow unit 40, when the paper sheet is fed from the drum 42 as the tapes 90, 92, 94 are unwound from the drum 42, as shown FIG. 18A, if there is a cut part in a front edge of the paper sheet in a feeding direction (shown with an arrow in FIG. 18A) of the paper sheet and if the paper sheet gets folded at this cut part, the folded part (shown with a reference letter S' in FIG. 18A) may contact the other surface of the tape 92 and the folded paper sheet may sandwich the tape 92 from both sides. If a part of the paper sheet gets folded at a cut part formed in the front edge of the paper sheet, it is possible that the folded paper sheet sandwiches the tape 92 from both sides even if this folded part does not contact the other surface of the tape 92. In this manner, when the folded paper sheet sandwiches the tape 92 from both sides, when the paper sheet is released near the guiding rollers 50 and 52 from the tapes 90, 92, 94, because the part of the paper sheet that got folded towards the other surface of the tape 92 may be caught between the tape 92 and the guiding roller 52, it is possible that the paper sheet gets torn at the cut part or an orientation of the paper sheet changes greatly.

Figure 10:
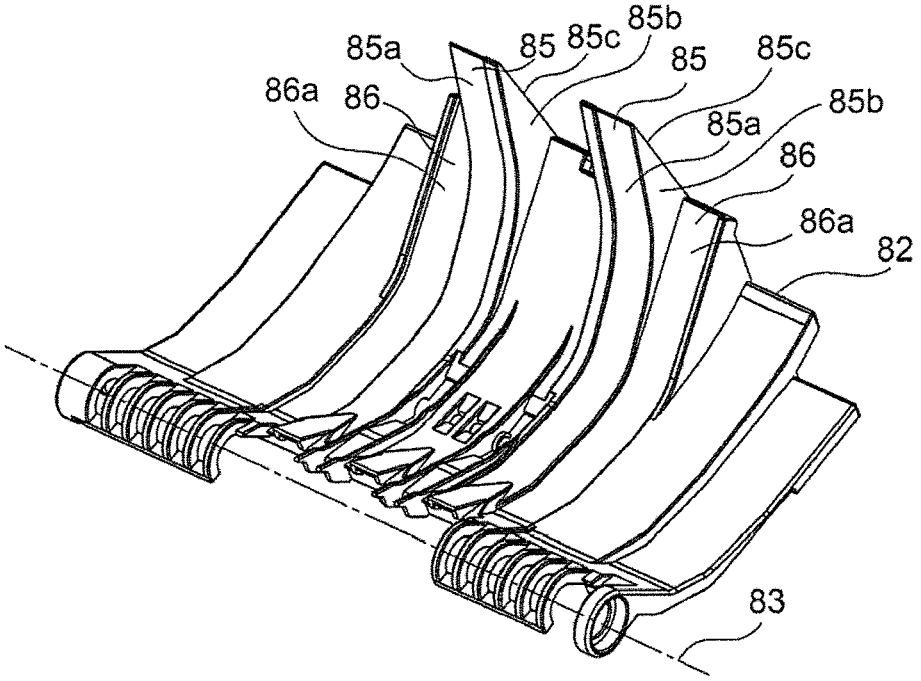
Figure 11:
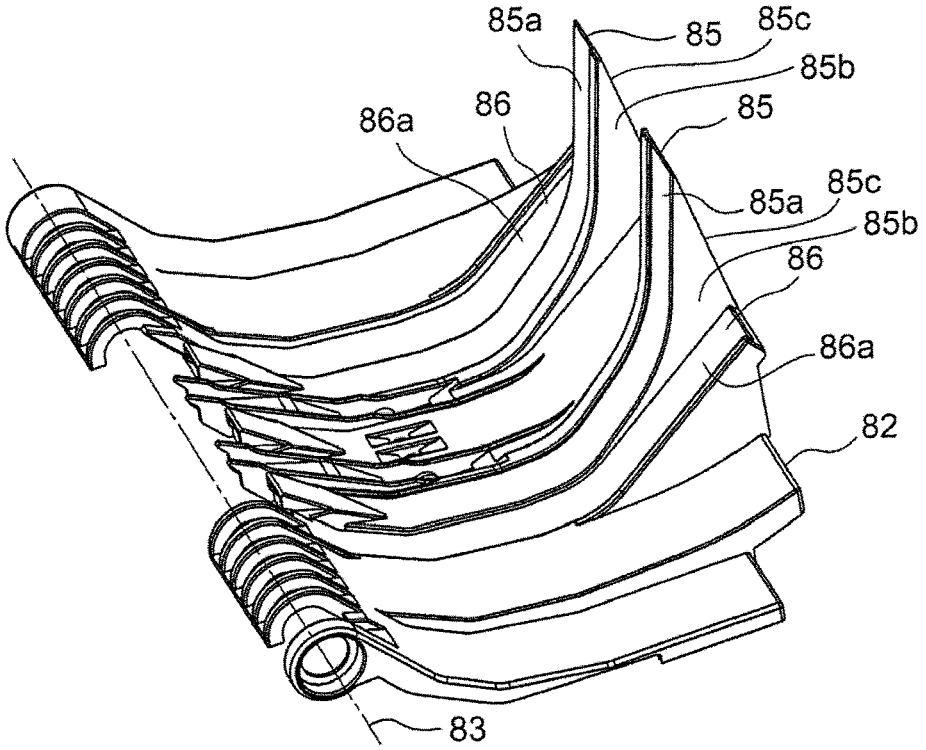
FIG. 11 is a perspective view of a configuration of the guiding unit shown in FIG. 10 when seen from a different angle.

As shown in FIG. 5 and the like, a pair of the guiding units 85 is arranged in the movable guide 82 opposite to each of the tapes 90 and 92. Moreover, in the movable guide 82, additional guiding units 86 that guide the paper sheet when the paper sheet is stored on the drum 42 as the tapes 90, 92, 94 are wound on the drum 42 are arranged on a side of each of the guiding units 85. Perspective views of the movable guide 82 in which are arranged the guiding units 85 and the additional guiding units 86 are shown in FIGS. 10 and 11. Each of the guiding units 85 prevents the folded paper sheet from sandwiching the corresponding tapes 90 and 94 from both sides if the paper sheet gets folded when the paper sheet is fed from the drum 42. As shown in FIGS. 5 and 6, a position of each of the guiding units 85 in the axial direction of the drum 42 (i.e., a position in the left-right direction of FIG. 6) is opposite to the corresponding tapes 90 and 94.

Moreover, as shown in FIGS. 5 and 6, the guiding unit 85 has a shape such that both the side edges thereof circumferentially extend along the drum 42 with a constant width in the axial direction of the drum 42 (i.e., a width in the left-right direction of FIG. 6) in a direction in which the paper sheet is fed from the drum 42 (i.e., in the lower direction in FIG. 6). Moreover, as shown in FIGS. 10 and 11, the guiding unit 85 is arranged so as to bend towards the drum 42 from a guide surface 86*a* of the corresponding additional guiding unit 86 that guides the paper sheet. Moreover, a guide surface 85*a* of each of the guiding units 85 is arranged facing a surface of the corresponding tapes 90 and 94 and with a small gap between the surface of the corresponding tapes 90 and 94 wound on the drum 42. The movable guide 82 to which the guiding units 85 have been attached is pivotable around the axis 83 depending on a quantity of the paper sheets stored on the drum 42. Because the movable guide 82 is pushed by the biasing unit such as the spring 89 in the counterclockwise direction in FIGS. 2 to 4 around the axis 83 so that the bearing 84 arranged in the movable guide 82 touches the paper sheet wound on the drum 42, irrespective of whether the quantity of the paper sheets stored on the drum 42 is large or small, a small gap is formed between the guide surfaces 85*a* of the guiding units 85 and the surface of the tapes 90 and 94 wound on the drum 42. Because the guiding units 85 having such a configuration are arranged opposite to the tapes 90 and 94 with a small gap formed between the tapes 90 and 94, even if the folded part of the paper sheet tries to ride on the surface of the tapes 90 and 94 when the paper sheet is fed from the drum 42 as the tapes 90, 92, 94 are unwound from the drum 42, it is inhibited that the folded part rides on the surface of the tapes 90 and 94 because the folded part of the paper sheet touches a side surface 85*b* and/or a side edge 85*c* of the guiding unit 85 (see FIGS. 10 and 11). Therefore, it is prevented that the folded paper sheet sandwiches the tapes 90 and 94 from both sides.

Figure 18B:
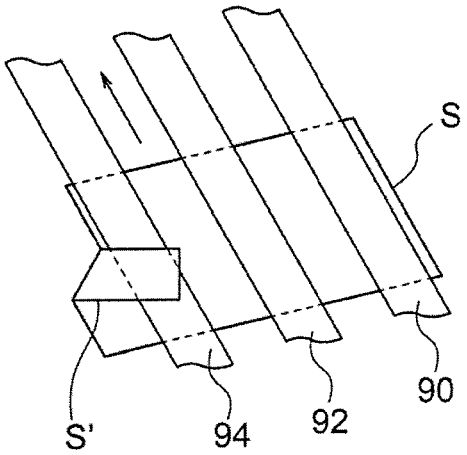

In other words, if such a guiding unit 85 is not arranged in the escrow unit 40, when the paper sheet is fed from the drum 42 as the tapes 90, 92, 94 are unwound from the drum 42, as shown FIG. 18B, if there is a cut part in a front edge of the paper sheet in a feeding direction (shown with an arrow in FIG. 18B) of the paper sheet, and if the paper sheet gets folded at this cut part, the folded part (shown with a reference letter S' in FIG. 18B) may contact the other surface of the tapes 90 and 94 (the tape 94 in the example shown in FIG. 18B) and the folded paper sheet may sandwich the tape 90 from both sides. When this happens, when the paper sheet is released near the guiding rollers 50 and 52 from the tapes 90, 92, 94, because the part of the paper sheet that got folded towards the other surface of the tape 94 is caught between the tape 94 and the guiding roller 50 and/or the guiding roller 52, it is possible that the paper sheet gets torn at the cut part or an orientation of the paper sheet changes greatly.

Figure 12:
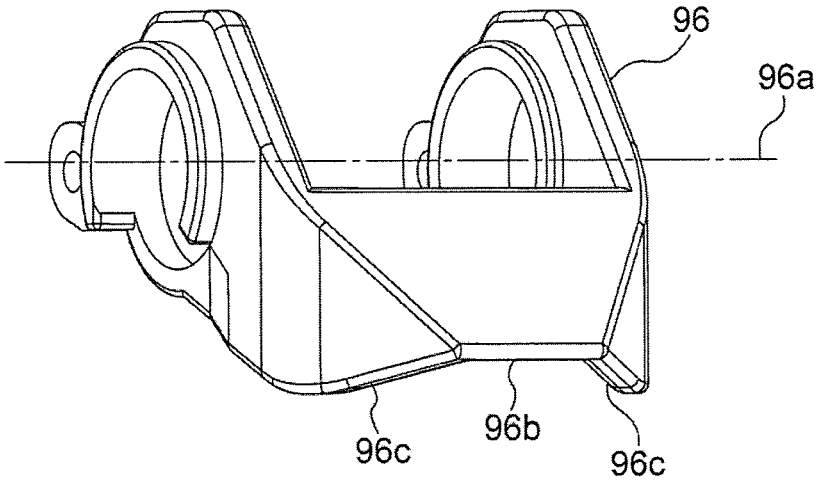

Moreover, as shown in FIGS. 2 to 4, scraper members 96 are arranged near the guiding rollers 50 in the escrow unit 40 according to the present embodiment. More particularly, two scraper members 96, each corresponding to each of the tapes 90 and 94, are arranged. Each of the tapes 90 and 94 present between the drum 42 and the corresponding guiding rollers 50 touches the corresponding scraper member 96. A configuration of the scraper member 96 is explained by using FIGS. 12 and 13. FIG. 12 is a perspective view of a configuration of the scraper member 96, and FIG. 13 is a front view of a configuration of the scraper member 96 shown in FIG. 12 when seen from front.

Figure 13:
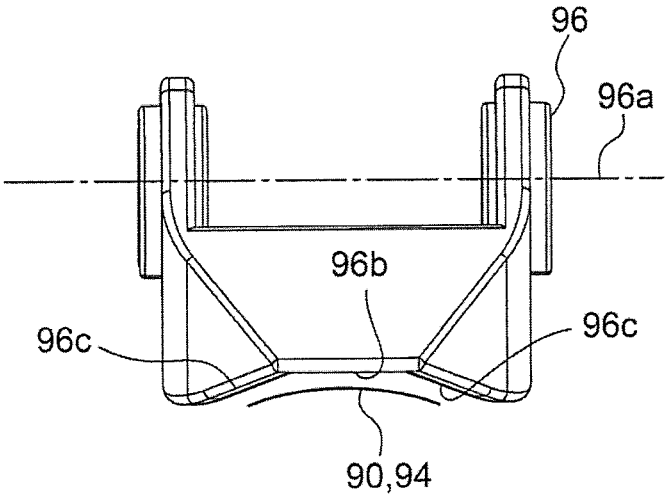
FIG. 13 is a front view of a configuration of the scraper member shown in FIG. 12 when seen from front.

As shown in FIGS. 12 and 13, the tapes 90 and 94 present between the drum 42 and the guiding rollers 50 touch tip parts 96*b* and 96*c* of the scraper members 96. A tip part of the scraper member 96 is not formed in a simple linear shape, but the tip part is constituted by a plurality of the tip parts 96*b* and 96*c* that extend in mutually different directions. When these tip parts 96*b* and 96*c* are assembled, so-called concave tip part is formed. Therefore, when the tapes 90 and 94 present between the drum 42 and the guiding rollers 50 touch the tip parts 96*b* and 96*c* of the scraper members 96, a cross-section of the tapes 90 and 94 changes from a linear shape to a curved shape (see FIG. 13). Note that, to facilitate the understanding of the shape of the tapes 90 and 94, a state in which the tapes 90 and 94 and the tip parts 96*b* and 96*c* are separated from each other has been shown in FIG. 13; however, actually the tapes 90 and 94 and the tip parts 96*b* and 96*c* contact each other. In this manner, among the tip parts 96*b* and 96*c* of the scraper member 96, the tip parts 96*c* on the sides have a shape that covers both the side edges of the corresponding tapes 90 and 94 that contact the scraper member 96.

Moreover, the scraper member 96 is rotatable around an axis 96*a* arranged coaxially with an axis of the guiding roller 50. Moreover, a biasing unit such as a torsion spring is arranged in the axis 96*a* of the scraper member 96. The scraper member 96 is biased by the biasing unit by a force that causes the scraper member 96 to rotate in the clockwise direction in FIGS. 2 to 4 around the axis 96*a*. Accordingly, as shown in FIGS. 2 to 4, irrespective of whether the quantity of the paper sheets stored on the drum 42 is large or small, the tip parts 96*b* and 96*c* of the scraper members 96 always touch the tapes 90 and 94 present between the drum 42 and the guiding rollers 50.

Moreover, as shown in FIG. 13, when the tapes 90 and 94 present between the drum 42 and the guiding rollers 50 touch the tip parts 96*b* and 96*c* of the scraper members 96, the cross-section of the tapes 90 and 94 changes from the linear shape to the curved shape. Therefore, when the tapes 90, 92, 94 are unwound from the drum 42, if the paper sheet released from the tapes 90, 92, 94 and/or the paper sheet that is present on an immediate inner side and wound in the outermost tapes 90, 92, 94 and that passes near the scraper members 96, has a cut part in a front edge of the paper sheet in a feeding direction, and even when a part of the paper sheet comes off at the cut part of the paper sheet from the tapes 90, 92, 94 wound on the drum 42 (such a part of the paper sheet that has come off is shown with a reference letter P and a two-dot chain line in FIG. 3), it can be prevented that this part of the paper sheet that has come off enters between the guiding rollers 50 and the tapes 90 and 94. More particularly, it can be prevented that a part of the paper sheet that has come off from the tapes 90, 92, 94 wound on the drum 42 enters between the scraper members 96 and the tapes 90 and 94. Also, assuming that this part of the paper sheet that has come off entered between the scraper members 96 and the tapes 90 and 94, it can be prevented that this part of the paper sheet is sent between the guiding rollers 50 and the tapes 90 and 94.

Figure 19:
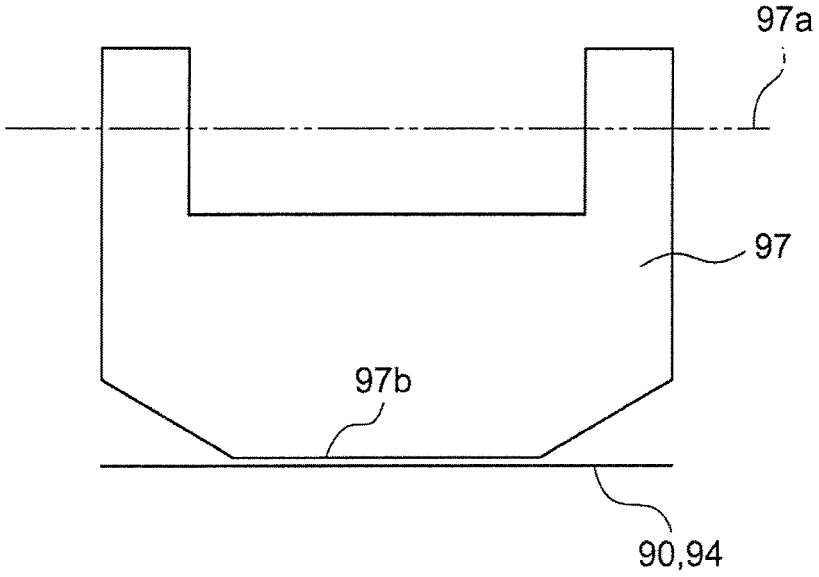
FIG. 19 is a front view of a configuration of a conventional scraper member.

As a comparative example, a configuration of a conventional scraper member is shown in FIG. 19. FIG. 19 is a front view of a configuration of a conventional scraper member 97. The conventional scraper member 97 is rotatable around an axis 97*a* arranged coaxially with the axis of the guiding roller 50. Moreover, a biasing unit such as a torsion spring is arranged in the axis 97*a* of the scraper member 97. The scraper member 97 is biased by the biasing unit by a force that causes the scraper member 97 to rotate around the axis 97*a* towards the tapes 90 and 94. Moreover, as shown in FIG. 19, the tapes 90 and 94 present between the drum 42 and the guiding rollers 50 touch a tip part 97*b* of the scraper members 97. The tip part 97*b* of the conventional scraper member 97 has a simple linear shape. Therefore, when the tapes 90 and 94 present between the drum 42 and the guiding rollers 50 touch the tip part 97*b* of the scraper members 97, the cross-section of the tapes 90 and 94 remains linear without changing. Accordingly, when the tapes 90, 92, 94 are unwound from the drum 42, if the paper sheet released from the tapes 90, 92, 94 and/or the paper sheet that is present on an immediate inner side and wound in the outermost tapes 90, 92, 94 and that passes near the scraper members 96, has a cut part in a front edge of the paper sheet in a feeding direction, and when a part of the paper sheet comes off at the cut part of the paper sheet from the tapes 90, 92, 94 wound on the drum 42, this part of the paper sheet that has come off may enter between the tip part 97*b* of the scraper members 97 and the tapes 90 and 94. At this time, this part of the paper sheet that passed between the tip part 97*b* of the scraper members 97 and the tapes 90 and 94 enters between the guiding rollers 50 and the tapes 90 and 94, and the paper sheet that should be unwound from the drum 42 may be torn from the part that has entered between the guiding rollers 50 and the tapes 90 and 94.

The scraper member 96 according to the present embodiment is not limited to the one having the configuration shown in FIGS. 12 and 13. The scraper member 96 shown in FIGS. 12 and 13 has a shape in which the tip parts 96*c* thereof cover both the side edges of the corresponding tapes 90 and 94 that contact the scraper member 96. In a scraper member according to a variation, only one tip part, not both the tip parts on the sides, has the configuration same as the tip part 96*c* shown in FIGS. 12 and 13. That is, it is allowable that only one side edge of the tapes 90 and 94 that contact the scraper members is covered with the tip part of the scraper members. In this configuration, when the tapes 90 and 94 present between the drum 42 and the guiding rollers 50 touch the scraper members, the cross-section of the tapes 90 and 94 becomes inclined from a horizontal state. Accordingly, it can be prevented that a part of the paper sheet that has come off from the tapes 90, 92, 94 wound on the drum 42 enters between the scraper members 96 and the tapes 90 and 94.

Figure 14:
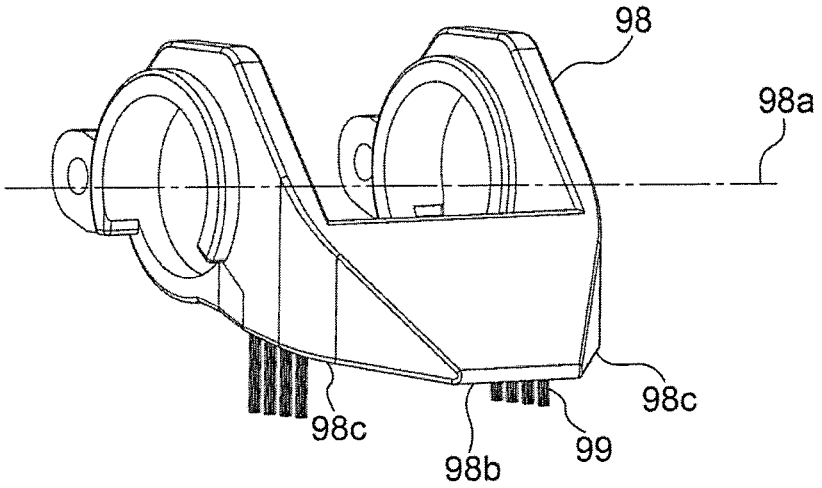
Figure 15:
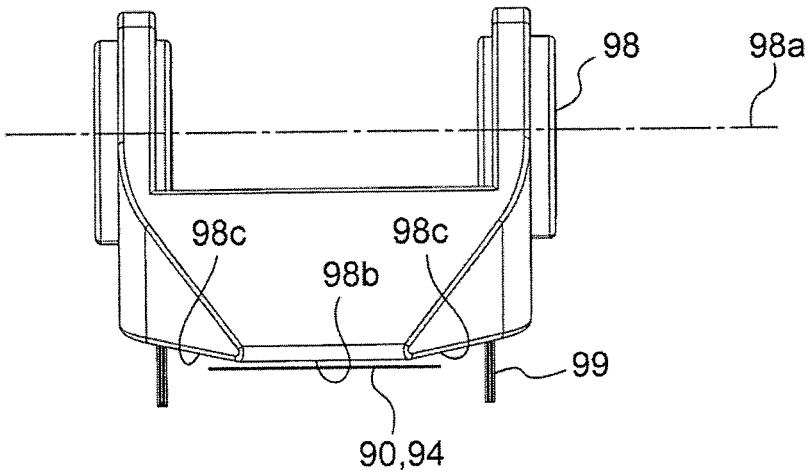
FIG. 15 is a front view of a configuration of the scraper member shown in FIG. 14 when seen from front.

Moreover, a scraper member according to the present embodiment having a different configuration is shown in FIGS. 14 and 15. A scraper member 98 shown in FIGS. 14 and 15 is rotatable around an axis 98*a* arranged coaxially with the axis of the guiding roller 50. Moreover, a biasing unit such as a torsion spring is arranged in the axis 98*a* of the scraper member 98. The scraper member 98 is biased by the biasing unit by a force that causes the scraper member 98 to rotate around the axis 98*a* towards the tapes 90 and 94. Moreover, the tapes 90 and 94 present between the drum 42 and the guiding rollers 50 touch tip parts 98*b* and 98*c* of the scraper members 98. A tip part of the scraper member 98 is not formed in a simple linear shape, but the tip part is constituted by a plurality of the tip parts 98*b* and 98*c* that extend in mutually different directions. Moreover, a brush member 99 that extends below is attached on each of the tip parts 98*c* on the sides. As shown in FIG. 15, when the tapes 90 and 94 present between the drum 42 and the guiding rollers 50 touch the tip parts 98*b* and 98*c* of the scraper members 98, each of the tapes 90 and 94 will be located between the brush members 99 provided on both the sides. Because such brush members 99 have been provided, when the paper sheet fed from the drum 42 as the tapes 90, 92, 94 are unwound from the drum 42 has a cut part in a front edge of the paper sheet in the feeding direction of the paper sheet, and even when a part of the paper sheet comes off at the cut part of the paper sheet from the tapes 90, 92, 94 wound on the drum 42, it can be prevented that this part of the paper sheet that has come off enters between the scraper members 98 and the tapes 90 and 94.

A configuration of a control system of the paper sheet handling machine 10 having the configuration shown in FIG. 1 is explained next by using FIG. 16. The paper sheet handling machine 10 according to the present embodiment includes a control unit 35. The first feeding mechanism 16 and the second feeding mechanism 18 arranged in the money depositing/dispensing unit 14, the transport unit 20, the recognition unit 22, the width-wise position aligning unit 24, the escrow unit 40, the feeding mechanism 31 arranged in each of the paper sheet storing and feeding units 30, the feeding mechanism 33 arranged in each of the paper sheet storing and feeding units 32 are communicably connected to the control unit 35. A recognition result of the paper sheet obtained in the recognition unit 22 is sent to the control unit 35. Moreover, the control unit 35 sends a command signal to each of the first feeding mechanism 16, the second feeding mechanism 18, the transport unit 20, the width-wise position aligning unit 24, the escrow unit 40, each of the feeding mechanisms 31, each of the feeding mechanisms 33, and the like to control these structural components.

Figure 16:
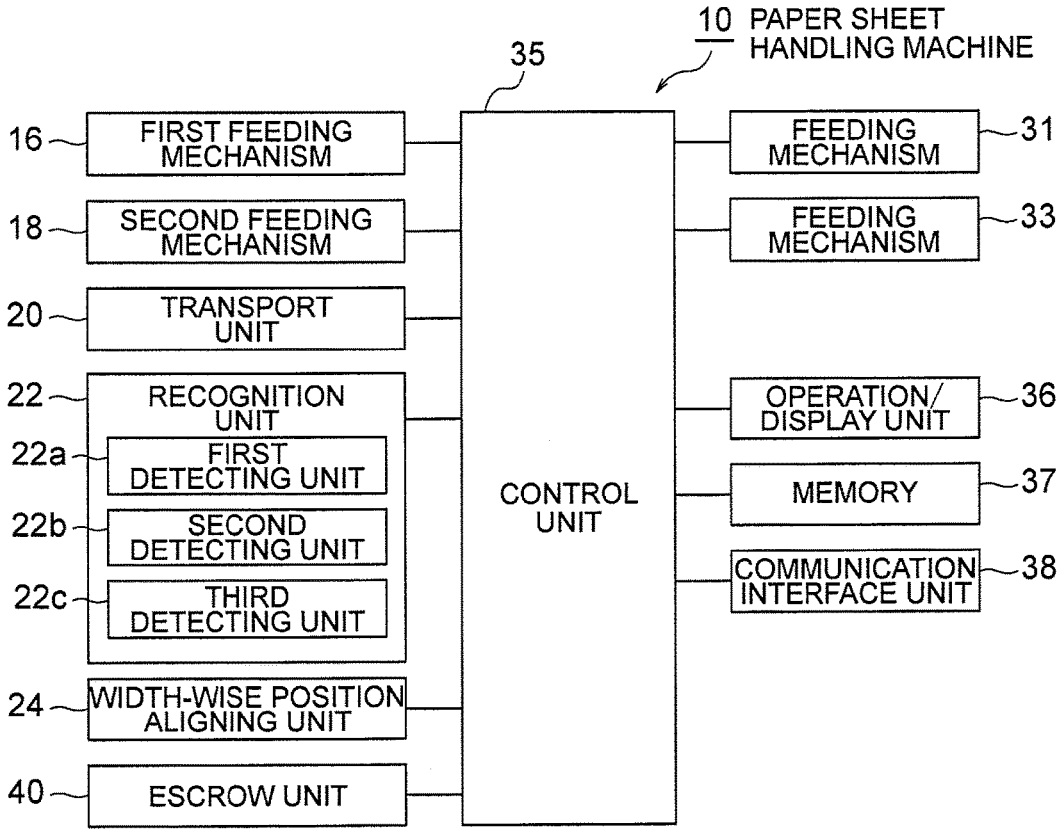
FIG. 16 is a functional block diagram of a configuration of a control system of the paper sheet handling machine shown in FIG. 1.

Moreover, as shown in FIG. 16, an operation/display unit 36, a memory 37, and a communication interface unit 38 are communicably connected to the control unit 35. The operation/display unit 36 is constituted by a touch screen and the like and it is arranged, for example, on a front surface or an upper surface of the housing 12. An operator can input various commands into the control unit 35 by using the operation/display unit 36. Moreover, on the operation/display unit 36 are displayed a processing content of the paper sheet in the paper sheet handling machine 10, an inventory amount of the paper sheets (specifically, banknotes and checks) stored in the paper sheet handling machine 10, and the like. The memory 37 stores therein information such as a history of the processing content of the paper sheet in the paper sheet handling machine 10, the inventory amount of the paper sheets (specifically, banknotes and checks) stored in the paper sheet handling machine 10, and the like. The control unit 35 of the paper sheet handling machine 10 is communicably connected to an external device such as a host terminal via the communication interface unit 38. Exchange of signals can be performed between the control unit 35 and the external device by using the communication interface unit 38.

Figure 32:
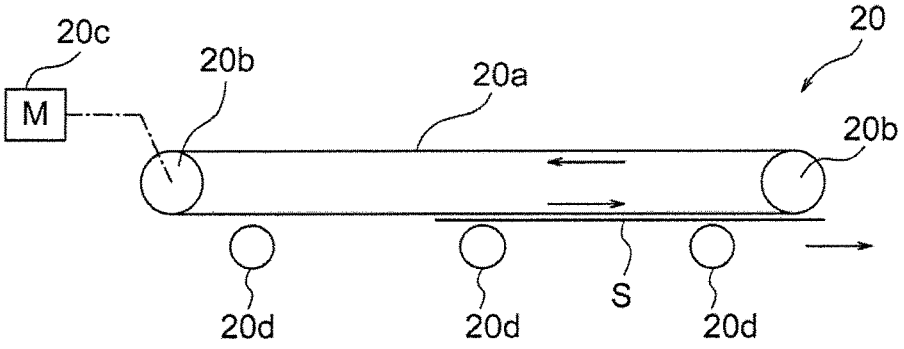
FIG. 32 is a detailed structural diagram of a configuration of a transport unit arranged in the paper sheet handling machine shown in FIG. 1.

A detailed configuration of the transport unit 20 arranged in the paper sheet handling machine 10 is explained below by using FIG. 32. As shown in FIG. 32, the transport unit 20 includes an endless belt 20*a*, a plurality of pinch rollers 20*d* arranged opposite to the endless belt 20*a*. When the endless belt 20*a* rotates, the paper sheets are transported one by one between the endless belt 20*a* and the pinch rollers 20*d*. Specifically, the endless belt 20*a* is looped on a plurality of pulleys 20*b* (two pulleys 20*b* are shown in the example shown in FIG. 32). One of the pulleys 20*b* among the pulleys 20*b* is driven in a forward and/or reverse direction by a motor 20*c* (e.g., a DC brushless motor). In the example shown in FIG. 32, when the motor 20*c* causes the pulley 20*b*, for example, to rotate in the counterclockwise direction, the endless belt 20*a* rotates in a direction shown with arrows in FIG. 32 whereby the paper sheet is transported between the endless belt 20*a* and the pinch rollers 20*d* in the right direction.

Figure 33:
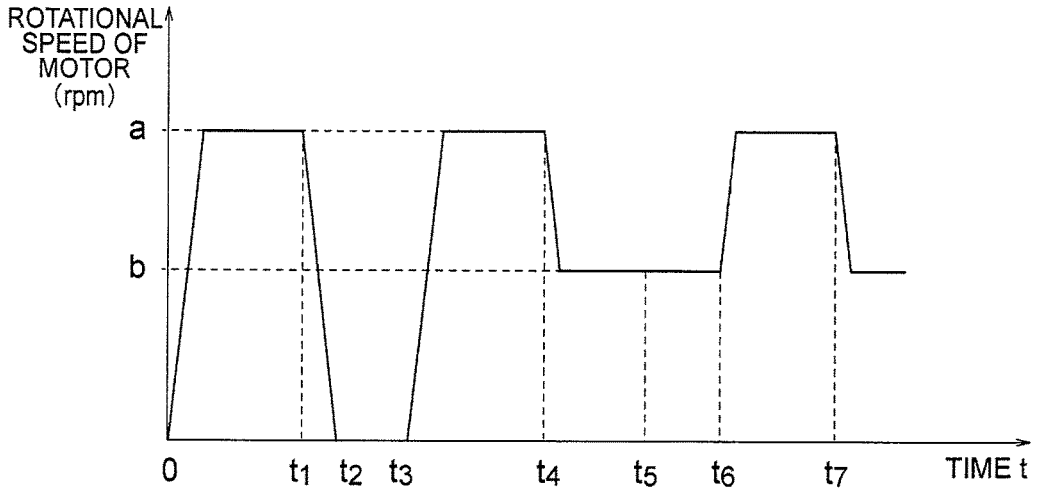
FIG. 33 is a graph indicating control contents of a motor of the transport unit controlled by a control unit in the paper sheet handling machine shown in FIG. 1, and a horizontal axis shows time and a vertical axis shows rotational speed of the motor (specifically, an instruction value of the rotational speed sent by the control unit to the motor of the transport unit).

In the present embodiment, the control unit 35 controls the motor 20*c* of the transport unit 20 by a method explained below. A control method of the motor 20*c* of the transport unit 20 used by the control unit 35 is explained by using a graph shown in FIG. 33. Note that, in the graph shown in FIG. 33, a horizontal axis shows time and a vertical axis shows rotational speed of the motor 20*c* (specifically, an instruction value of the rotational speed sent by the control unit 35 to the motor 20*c* of the transport unit 20).

When starting the transport unit 20, the control unit 35 first rotates the motor 20*c* at a first rotational speed a (e.g., about 1600 rpm). Specifically, assume that an instruction value of the rotational speed sent by the control unit 35 to the motor 20*c* of the transport unit 20 is the first rotational speed a. The first rotational speed a is a speed at which the paper sheet is transported at a usual transport speed in a usual operation by the endless belt 20*a* of the transport unit 20. However, the endless belt 20*a* stiffens in a low temperature environment. If the endless belt 20*a* is driven in the low temperature environment, even if the instruction value of the rotational speed sent by the control unit 35 to the motor 20*c* of the transport unit 20 is the first rotational speed a, the actual rotational speed of the motor 20*c* may not reach the first rotational speed a. Therefore, after setting the instruction value of the rotational speed sent by the control unit 35 to the motor 20*c* of the transport unit 20 to the first rotational speed a, even if the actual rotational speed of the motor 20*c* does not reach the first rotational speed a (see a time point t1 in FIG. 33) within a predetermined time (e.g., two seconds), if each of the structural components have been set correctly in the housing 12 of the paper sheet handling machine 10, the control unit 35 temporarily stops the motor 20*c* (see a time point t2 in FIG. 33). After stopping the motor 20*c*, when a predetermined time (e.g., one second) has elapsed (see a time point t3 in FIG. 33), the control unit 35 again rotates the motor 20*c* at the first rotational speed a (i.e., sets the instruction value of the rotational speed sent by the control unit 35 to the motor 20*c* of the transport unit 20 to the first rotational speed a). On the other hand, when the actual rotational speed of the motor 20*c* does not reach the first rotational speed a and the structural components have not been set correctly in the housing 12 of the paper sheet handling machine 10, the control unit 35 determines this situation as a malfunction error and stops the operation of the structural components of the paper sheet handling machine 10, and causes the operation/display unit 36 to display information that indicates that the malfunction error has occurred.

After setting the instruction value of the rotational speed sent by the control unit 35 to the motor 20*c* of the transport unit 20 again to the first rotational speed a, if the actual rotational speed of the motor 20*c* does not reach the first rotational speed a (see a time point t4 in FIG. 33) within a predetermined time (e.g., 0.8 second), the instruction value of the rotational speed sent by the control unit 35 to the motor 20*c* of the transport unit 20 is reduced from the first rotational speed a to a second rotational speed b (e.g., about 1300 rpm). After reducing the instruction value of the rotational speed sent by the control unit 35 to the motor 20*c* of the transport unit 20 to the second rotational speed b, if the actual rotational speed of the motor 20*c* does not reach the second rotational speed b (see a time point t5 in FIG. 33) within a predetermined time (e.g., 1.6 seconds), the control unit 35 determines this situation as a malfunction error and stops the operation of the structural components of the paper sheet handling machine 10, and causes the operation/display unit 36 to display information that indicates that the malfunction error has occurred. In detail, because the second rotational speed b is set to a rotational speed achievable even if the endless belt 20*a* stiffens most, the cause of the rotational speed not reaching the second rotational speed b is not the stiffening of the belt. Therefore, it is assumed that an excessive load is being applied because of a foreign substance being caught somewhere, and this situation is determined as a malfunction error and the operation of the paper sheet handling machine 10 is stopped. On the other hand, after reducing the instruction value of the rotational speed sent by the control unit 35 to the motor 20*c* of the transport unit 20 to the second rotational speed b, if the actual rotational speed of the motor 20*c* reaches the second rotational speed b (see the time point t5 in FIG. 33) within a predetermined time (e.g., 1.6 seconds), the control unit 35 further rotates the motor 20*c* at the second rotational speed b (see a time point t6 in FIG. 33) for a predetermined time (e.g., 1.4 seconds), and then increases the instruction value of the rotational speed sent by the control unit 35 to the motor 20*c* of the transport unit 20 from the second rotational speed b to the first rotational speed a.

After setting the instruction value of the rotational speed sent by the control unit 35 to the motor 20*c* of the transport unit 20 again to the first rotational speed a, if the actual rotational speed of the motor 20*c* reaches the first rotational speed a (see a time point t7 in FIG. 33) after elapse of a predetermined time (e.g., 0.8 second), the control unit 35 causes the motor 20*c* to perform the steady operation at the first rotational speed a. On the other hand, after setting the instruction value of the rotational speed sent by the control unit 35 to the motor 20*c* of the transport unit 20 again to the first rotational speed a, if the actual rotational speed of the motor 20*c* does not reach the first rotational speed a (see the time point t7 in FIG. 33) within a predetermined time (e.g., 0.8 second), the instruction value of the rotational speed sent by the control unit 35 to the motor 20*c* of the transport unit 20 is reduced from the first rotational speed a to the second rotational speed b (e.g., about 1300 rpm). Such a retry operation of reducing the instruction value of the rotational speed sent to the motor 20*c* of the transport unit 20 from the first rotational speed a to the second rotational speed b is performed at the most for a predetermined number of times (e.g., 10 times) set previously. If the actual rotational speed of the motor 20*c* does not reach the first rotational speed a even after performing the retry operation for the predetermined number of times set previously, the control unit 35 determines this situation as a malfunction error and stops the operation of the structural components of the paper sheet handling machine 10, and causes the operation/display unit 36 to display information that indicates that the malfunction error has occurred.

As explained above, in the present embodiment, by performing the retry operation in which the instruction value of the rotational speed sent to the motor 20*c* of the transport unit 20 is reduced from the first rotational speed a to the second rotational speed b, the endless belt 20*a* can be rotated at a low speed. Accordingly, even when the endless belt 20*a* stiffens in the low temperature environment, the transport unit 20 can be caused to perform the steady operation after softening the endless belt 20*a* without applying an excessive load on the motor 20*c*. That is, in a conventional control method of the motor 20*c* of the transport unit 20, even if the instruction value of the rotational speed sent by the control unit 35 to the motor 20*c* of the transport unit 20 is set to the first rotational speed a when starting the transport unit 20, if the actual rotational speed of the motor 20*c* does not reach the first rotational speed a, this situation is determined as a malfunction error and the operation of the structural components of the paper sheet handling machine 10 is stopped instead of reducing the instruction value of the rotational speed sent to the motor 20*c* of the transport unit 20 from the first rotational speed a. In this manner, because the operation to soften the endless belt 20*a* by rotating the endless belt 20*a* at a low speed is not performed in the conventional art, a large-sized motor 20*c* must be used to address a situation in which the endless belt 20*a* may stiffen in the low temperature environment. This leads to disadvantages that the cost of the transport unit 20 increases, a large space is required to install the motor 20*c*, and the like. In contrast, in the present embodiment, a smaller motor 20*c* can be used in comparison with the conventional art. Accordingly, the cost of the transport unit 20 can be reduced, and the space to install the motor 20*c* can be reduced. Moreover, because the number of times to perform the retry operation can be set depending on a degree of stiffening of the endless belt 20*a*, the time before the endless belt 20*a* starts performing the usual operation can be made the shortest.

Moreover, in the present embodiment, as shown in FIG. 16, the recognition unit 22 includes a first detecting unit 22*a* that detects the cut part of the paper sheet transported by the transport unit 20, a second detecting unit 22*b* that detects a position of a predetermined location in the width direction of the paper sheet (e.g., the position of the central portion in the width direction of the paper sheet) transported by the transport unit 20, and a third detecting unit 22*c* that detects face side up/back side up of a banknote when the paper sheet transported by the transport unit 20 is the banknote. Specifically, an image sensor is arranged in the recognition unit 22. An image of the surface of the paper sheet is acquired by the image sensor. The first detecting unit 22*a* detects whether a cut part is present in the paper sheet based on the image of the surface of the paper sheet acquired by the image sensor. Specifically, the first detecting unit 22*a* detects whether a cut part is present in a front edge or a rear edge of the paper sheet in the transport direction of the paper sheet by the transport unit 20, and detects a position of the cut part in the width direction of the paper sheet transported by the transport unit 20. Moreover, the second detecting unit 22*b* detects the position of the predetermined location in the width direction of the paper sheet based on the image of the surface of the paper sheet acquired by the image sensor. Moreover, the third detecting unit 22*c* detects the face side up/back side up of the banknote recognized by the recognition unit 22 based on a comparison between the image of the surface of the banknote acquired by the image sensor and an image of a front surface and an image of a back surface of the banknote previously stored in the memory 37. Note that, the image sensor in the recognition unit 22 can be substituted with an ultrasonic sensor or a magnetic sensor. By providing the ultrasonic sensor in the recognition unit 22, in case the cut part occurs in the paper sheet, the presence/absence and the position of the cut part can be detected. Moreover, by providing the magnetic sensor in the recognition unit 22, the face side up/back side up of the banknote can be detected by detecting a position of a thread in the banknote by using the magnetic sensor.

An operation of the paper sheet handling machine 10 according to the present embodiment having such a configuration is explained below. The operation of the paper sheet handling machine 10 explained below is performed by the control unit 35 by controlling the various structural components of the paper sheet handling machine 10.

An operator inserts one or more paper sheets into the money depositing/dispensing unit 14 in a stacked manner, and inputs a command into the control unit 35 by using the operation/display unit 36 to start a money deposition process. The paper sheets inserted into the money depositing/dispensing unit 14 are fed one by one to the transport unit 20 by the first feeding mechanism 16. The paper sheets are transported one by one by the transport unit 20. The paper sheet transported by the transport unit 20 is recognized by the recognition unit 22. Specifically, the image of the surface of the paper sheet is acquired by the image sensor arranged in the recognition unit 22. The first detecting unit 22*a* detects whether the cut part is present in the paper sheet based on the image of the surface of the paper sheet acquired by the image sensor. Specifically, the first detecting unit 22*a* detects whether the cut part is present in the front edge or the rear edge of the paper sheet in the transport direction of the paper sheet by the transport unit 20, and detects the position of the cut part in the width direction of the paper sheet transported by the transport unit 20.

Figure 17:
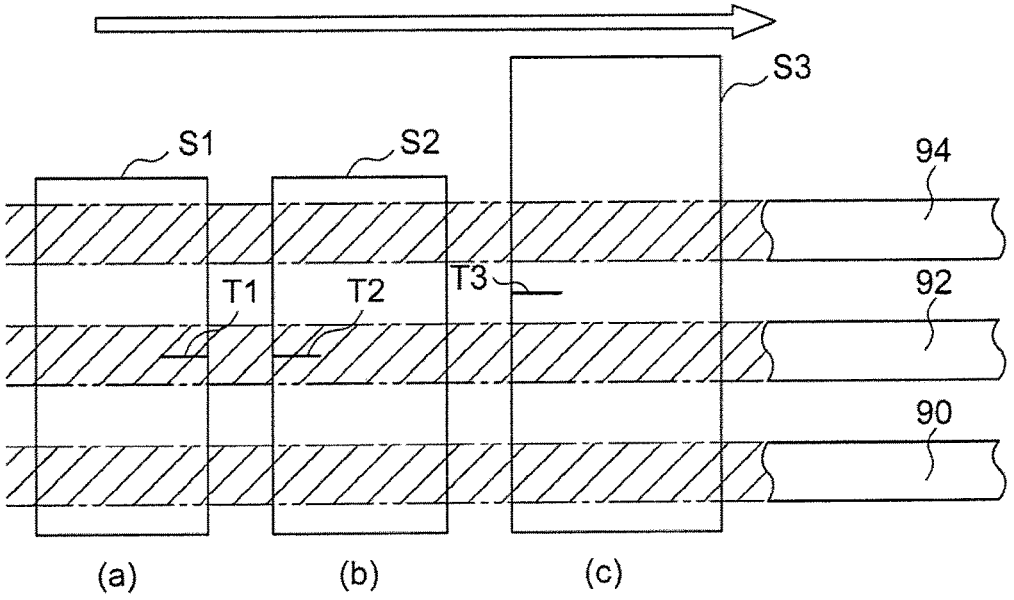
FIG. 17 is a view indicating a positional relationship between a cut part formed in a paper sheet transported inside a body of the paper sheet handling machine shown in FIG. 1 and each of the tapes arranged in the escrow unit.

When the paper sheet recognized by the recognition unit 22 is normal, and the first detecting unit 22*a* detects that no cut part is present in the rear edge of the paper sheet in the transport direction of the paper sheet by the transport unit 20, this paper sheet is transported by the transport unit 20 to the escrow unit 40. This is explained by using a paper sheet S1 shown in FIG. 17(*a*). In FIG. 17, the transport direction of the paper sheet by the transport unit 20 is the right direction. In the paper sheet S1 shown in FIG. 17(*a*), a cut part T1 is formed in a front edge in the transport direction of the transport unit 20, but no cut part is formed in the rear edge in the transport direction of the transport unit 20.

Even if such a paper sheet, in which no cut part is formed in the rear edge in the transport direction of the transport unit 20, is wound with the tapes 90, 92, 94 on the drum 42 in the escrow unit 40, because no cut part is present in the front edge in the feeding direction of the paper sheet when the paper sheet is fed from the drum 42, as shown in FIGS. 18A and 18B, there is no chance of the paper sheet getting folded at the cut part formed in the front edge of the paper sheet and sandwiching the tapes 90, 92, 94 from both sides. Therefore, when the paper sheet is released near the guiding rollers 50 and 52 from the tapes 90, 92, 94, there is no chance that the paper sheet gets torn or the orientation of the paper sheet changes greatly near a place where the paper sheet is released from the tapes 90, 92, 94.

Moreover, even if it is detected by the first detecting unit 22*a* that the cut part is present in the rear edge of the paper sheet in the transport direction of the paper sheet by the transport unit 20, if the position of the cut part in the width direction of the paper sheet matches with the position of one of the tapes 90, 92, 94 in the axial direction of the drum 42 of the escrow unit 40, this paper sheet is transported by the transport unit 20 to the escrow unit 40. This is explained by using a paper sheet S2 shown in FIG. 17(*b*). In the paper sheet S2 shown in FIG. 17(*b*), a cut part T2 is formed in a rear edge in the transport direction of the transport unit 20, and a position of the cut part T2 in the width direction of the paper sheet S2 matches with the position of one of the tapes 90, 92, 94 (specifically, the position of the tape 92) in the axial direction of the drum 42 of the escrow unit 40.

When such a paper sheet, in which the position of the cut part in the width direction matches with the position of one of the tapes 90, 92, 94 in the axial direction of the drum 42 of the escrow unit 40, is wound along with the tapes 90, 92, 94 on the drum 42 in the escrow unit 40, the cut part will be present in the front edge in the feeding direction of the paper sheet when the paper sheet is fed from the drum 42. However, because the position of the cut part in the width direction of the paper sheet matches with the position of one of the tapes 90, 92, 94 in the axial direction of the drum 42 of the escrow unit 40, the cut part of the paper sheet will be pressed by the tapes 90, 92, 94 when the paper sheet is fed from the drum 42. Accordingly, it is prevented that the paper sheet gets folded at the cut part. Accordingly, when the paper sheet is fed from the drum 42, it is prevented that the paper sheet folded at the cut part sandwiches the tapes 90, 92, 94 from both sides. Therefore, when the paper sheet is released near the guiding rollers 50 and 52 from the tapes 90, 92, 94, there is no chance that the paper sheet gets torn or the orientation of the paper sheet changes greatly near the place where the paper sheet is released from the tapes 90, 92, 94.

On the other hand, if it is detected by the first detecting unit 22*a* that the cut part is present in the rear edge of the paper sheet in the transport direction of the paper sheet by the transport unit 20, and that the position of the cut part in the width direction of the paper sheet does not match with the position of any of the tapes 90, 92, 94 in the axial direction of the drum 42 of the escrow unit 40, this paper sheet is transported by the transport unit 20 to some place other than the escrow unit 40. Specifically, such a paper sheet is transported to the money depositing/dispensing unit 14 by the transport unit 20. This is explained by using a paper sheet S3 shown in FIG. 17(*c*). In the paper sheet S3 shown in FIG. 17(*c*), a cut part T3 is formed in a rear edge in the transport direction of the transport unit 20, and a position of the cut part T3 in the width direction of the paper sheet S3 does not match with the position of any of the tapes 90, 92, 94 in the axial direction of the drum 42 of the escrow unit 40.

When such a paper sheet, in which the cut part is formed in the rear edge in the transport direction of the transport unit 20 and the position of the cut part in the width direction does not match with the position of any of the tapes 90, 92, 94 in the axial direction of the drum 42 of the escrow unit 40, is wound along with the tapes 90, 92, 94 on the drum 42 in the escrow unit 40, the cut part will be present on the front edge in the feeding direction of the paper sheet when the paper sheet is fed from the drum 42. As shown in FIGS. 18A and 18B, it is possible that the paper sheet gets folded at the cut part formed in the front edge of the paper sheet and sandwiches the tapes 90, 92, 94 from both sides. Therefore, when the paper sheet is released near the guiding rollers 50 and 52 from the tapes 90, 92, 94, it is possible that the paper sheet gets torn or the orientation of the paper sheet changes greatly near the place where the paper sheet is released from the tapes 90, 92, 94. Accordingly, by transporting such a paper sheet to some other place (specifically, the money depositing/dispensing unit 14) other than the escrow unit 40 by the transport unit 20, the above issues can be prevented beforehand.

The money depositing/dispensing unit 14 functions as an orientation changing unit that changes an orientation of the paper sheet whose detection was performed by the first detecting unit 22*a*. Specifically, the orientation of the paper sheet is changed by returning the paper sheet sent to the money depositing/dispensing unit 14 from the transport unit 20 to the transport unit 20 by the second feeding mechanism 18. The paper sheet, in which the cut part is formed in the rear edge in the transport direction of the transport unit 20 and the position of the cut part in the width direction does not match with the position of any of the tapes 90, 92, 94 in the axial direction of the drum 42 of the escrow unit 40, is first sent to the money depositing/dispensing unit 14. Thereafter, when the paper sheet is returned from the money depositing/dispensing unit 14 to the transport unit 20 by the second feeding mechanism 18, the orientation (specifically, the orientation of the paper sheet in the transport direction of the transport unit 20) of the paper sheet returned to the transport unit 20 is changed. Specifically, the front edge of the paper sheet and the rear edge thereof are switched in the transport direction of the paper sheet by the transport unit 20. The paper sheet returned to the transport unit 20 from the money depositing/dispensing unit 14 is sent again to the recognition unit 22 and recognition of the paper sheet is performed by the recognition unit 22. In this case, if a cut part is not present in the rear edge of the paper sheet in the transport direction of the paper sheet by the transport unit 20 (see the paper sheet S1 in FIG. 17(*a*)), or when a cut part is present in the rear edge of the paper sheet in the transport direction of the paper sheet by the transport unit 20 but the position of the cut part in the width direction of the paper sheet matches with the position of one of the tapes 90, 92, 94 in the axial direction of the drum 42 of the escrow unit 40 (see the paper sheet S2 in FIG. 17(*b*)), such a paper sheet is transported to the escrow unit 40. Note that, when the paper sheet is returned to the transport unit 20 from the money depositing/dispensing unit 14, sent again to the recognition unit 22, and the recognition of the paper sheet is performed by the recognition unit 22, if the cut part is still present in the rear edge of the paper sheet in the transport direction of the paper sheet by the transport unit 20 and the position of the cut part in the width direction of the paper sheet does not match with the position of any of the tapes 90, 92, 94 in the axial direction of the drum 42 of the escrow unit 40, such a paper sheet is sent again to the money depositing/dispensing unit 14 as a reject paper sheet. This paper sheet is then taken out by the operator.

When the paper sheet, in which the cut part is formed in the rear edge in the transport direction of the transport unit 20 and the position of the cut part in the width direction does not match with the position of any of the tapes 90, 92, 94 in the axial direction of the drum 42 of the escrow unit 40, is sent to the money depositing/dispensing unit 14, instead of returning such a paper sheet to the transport unit 20 by the second feeding mechanism 18, it is allowable that the operator takes the paper sheet out of the money depositing/dispensing unit 14. Thereafter, the operator can manually change the orientation of this taken out paper sheet and reinsert the paper sheet in the money depositing/dispensing unit 14 so that the paper sheet is fed to the transport unit 20 by the first feeding mechanism 16 of the money depositing/dispensing unit 14. At this time, a guidance message that guides the operator to reinsert the paper sheet can be displayed on the operation/display unit 36. Specifically, the guidance message can be displayed on the operation/display unit 36 that guides the operator to reinsert the paper sheet in such a manner that a lower end of the paper sheet returned to the money depositing/dispensing unit 14 will remain the lower end at the time of the reinserting so that the cut part of the reinserted paper sheet is located in the front edge in the transport direction. When the paper sheet is reinserted in the money depositing/dispensing unit 14 and the paper sheet is fed to the transport unit 20 by the first feeding mechanism 16 of the money depositing/dispensing unit 14, this paper sheet is sent again to the recognition unit 22 and the recognition of the paper sheet is performed by the recognition unit 22.

When, after all the paper sheets inserted by the operator in the money depositing/dispensing unit 14 are fed to the transport unit 20 from the money depositing/dispensing unit 14 and are escrowed in the escrow unit 40, the operator gives an approval order to the control unit 35 by using the operation/display unit 36, the paper sheets are fed one by one to the transport unit 20 from the escrow unit 40 by unwinding the paper sheets along with the tapes 90, 92, 94 from the drum 42. The paper sheet fed to the transport unit 20 is transported to one of the paper sheet storing and feeding units 30 or one of the paper sheet storing and feeding units 32 by the transport unit 20. When all the paper sheets escrowed in the escrow unit 40 are stored in the paper sheet storing and feeding units 30 or the paper sheet storing and feeding units 32, the storing operation of the paper sheets in the paper sheet handling machine 10 is completed.

Note that, in the present embodiment, when controlling the transport unit 20 by the control unit 35 to change a transportation destination of the paper sheet between the escrow unit 40 and some other place based on the position of the cut part of the paper sheet detected by the first detecting unit 22*a*, a control method other than the one explained above can be used. As another control method used by the control unit 35, for example, when the paper sheet recognized by the recognition unit 22 is normal and the first detecting unit 22*a* detects that the cut part is present in the rear edge of the paper sheet in the transport direction of the paper sheet by the transport unit 20, irrespective of the position of the cut part in the width direction of the paper sheet (i.e., even when the position of the cut part in the width direction of the paper sheet matches with the position of one of the tapes 90, 92, 94 in the axial direction of the drum 42 of the escrow unit 40), the paper sheet can be transported by the transport unit 20 to a place (specifically, the money depositing/dispensing unit 14) other than the escrow unit 40.

According to the paper sheet storing/feeding device (specifically, the escrow unit 40) according to the present embodiment having the above configuration, the guiding units 80 and 85 are arranged to guide the paper sheet to prevent the paper sheet from sandwiching the tapes 90, 92, 94 from both sides when the paper sheet is fed from the drum 42 by unwinding the tapes 90, 92, 94 from the drum 42. Because such guiding units 80 and 85 are arranged, when the paper sheet gets folded as the paper sheet is fed from the drum 42, it is prevented by the guiding units 80 and 85 that the folded paper sheet sandwiches the tapes 90, 92, 94 from both sides. Therefore, it is prevented that the paper sheet gets torn or the orientation of the paper sheet changes greatly near the place (specifically, near the guiding rollers 50 and 52) where the paper sheet is released from the tapes 90, 92, 94.

Moreover, as explained above, in the paper sheet storing/feeding device according to the present embodiment, a position of each of the guiding units 80 and 85 in the axial direction of the drum 42 is opposite to the corresponding tapes 90, 92, 94. Moreover, a shape of the guiding unit 80 that opposes the central tape 92 is such that, the folded part of the paper sheet moves away from the tape 92 in the axial direction of the drum 42 when the paper sheet is fed from the drum 42 as the tapes 90, 92, 94 are unwound from the drum 42. More particularly, the guiding unit 80 has a shape such that a width thereof in the axial direction of the drum 42 gradually increases in a direction in which the paper sheet is fed from the drum 42. Moreover, the guiding units 85 that oppose the side tapes 90 and 94 have a shape such that both the side edges thereof circumferentially extend along the drum 42 with a constant width in the axial direction of the drum 42 in a direction in which the paper sheet is fed from the drum 42.

Moreover, as explained above, in the paper sheet storing/feeding device according to the present embodiment, the tapes 90, 92, 94 are arranged side-by-side in the axial direction of the drum 42, and the plurality of the guiding units (specifically, the guiding unit 80 and the guiding units 85) are arranged corresponding to each of the tapes 90, 92, 94.

Moreover, as explained above, in the paper sheet storing/feeding device according to the present embodiment, the additional guiding unit 86 that guides the paper sheet while the paper sheet is stored on the drum 42 when the tapes 90, 92, 94 are wound on the drum 42 is arranged, and the additional guiding unit 86 is pivotable around the axis 83 depending on the quantity of the paper sheets stored on the drum 42. Specifically, the movable guide 82 to which the additional guiding units 86 have been attached is pivotable around the axis 83 depending on the quantity of the paper sheets stored on the drum 42. The guiding unit 85 is attached to the additional guiding unit 86. In this case, irrespective of whether the quantity of the paper sheets stored on the drum 42 is large or small, a small gap is formed between the guide surfaces 85*a* of the guiding units 85 and the surface of the tapes 90 and 94 wound on the drum 42. Moreover, in this case, the guiding unit 85 is arranged so as to protrude towards the drum 42 from the guide surface 86*a* of the corresponding additional guiding unit 86 that guides the paper sheet.

Moreover, as explained above, in the paper sheet storing/feeding device according to the present embodiment, the guiding unit 80 arranged opposite to the central tape 92 is pivotable around the axis 81 depending on the quantity of the paper sheets stored on the drum 42, and the guiding unit 80 can touch the tape 92 that has been wound on the drum 42.

Moreover, as explained above, in the paper sheet storing/feeding device according to the present embodiment, near the guiding rollers 50 that guide the tapes 90 and 94 unwound from the drum 42, the scraper members 96 to which the tapes 90 and 94 present between the drum 42 and the guiding rollers 50 touch are arranged as a winding member guiding unit, and the scraper member 96 has a shape that attempts to prevent the paper sheet unwound from the drum 42 from entering between the guiding roller 50 and the corresponding tapes 90 and 94. More particularly, the scraper member 96 has a shape that attempts to prevent the paper sheet unwound from the drum 42 from entering between the scraper member 96 and the corresponding tapes 90 and 94. Because such a scraper member 96 has been arranged, when the paper sheet fed from the drum 42 as the tapes 90, 92, 94 are unwound from the drum 42 has a cut part in a front edge of the paper sheet in the feeding direction of the paper sheet, and even when a part of the paper sheet comes off due to the cut part of the paper sheet from the tapes 90, 92, 94 wound on the drum 42, it can be prevented that this part of the paper sheet that has come off enters between the scraper member 96 and the tapes 90 and 94. Moreover, even if the part of the paper sheet that has come off enters between the scraper member 96 and the corresponding tapes 90 and 94, it is prevented that this part that has come off is sent between the guiding roller 50 and the tapes 90 and 94.

The scraper member 96 has a shape that covers at least one side edge of the corresponding tapes 90 and 94 that contact the scraper member 96. More preferably, the scraper member 96 has a shape that covers both the side edges of the corresponding tapes 90 and 94 that contact the scraper member 96. Moreover, the scraper member 96 has a shape that changes the cross-section of the corresponding tapes 90 and 94 that contact the scraper member 96 from a linear shape.

Moreover, according to the paper sheet handling machine 10 according to the present embodiment having the above configuration, the control unit 35 controls the transport unit 20 based on the position of the cut part of the paper sheet detected by the first detecting unit 22*a* so that the transportation destination of the paper sheet whose detection was performed by the first detecting unit 22*a* is switched between the paper sheet storing/feeding device (specifically, the escrow unit 40) and some other place. In this manner, by detecting the position of the cut part of the paper sheet with the first detecting unit 22*a* before the paper sheet is transported to the paper sheet storing/feeding device, stucking of the paper sheet, which has the cut part at a certain position and that may get torn or whose orientation may change greatly at an exit when fed from the paper sheet storing/feeding device, near the exit of the paper sheet storing/feeding device can be prevented by providing a control not to transport this paper sheet to the paper sheet storing/feeding device.

When the paper sheet storing/feeding device is the tape-type paper sheet storing/feeding device including the drum 42 to the outer peripheral surface of which one end of each of the belt-shaped tapes 90, 92, 94 for winding a plurality of paper sheets one by one has been connected, among the paper sheets detected by the first detecting unit 22*a*, the paper sheet that has the cut part that may cause a fold and lead to sandwiching the tapes 90, 92, 94 from both sides when the paper sheet is fed from the drum 42 is prohibited from being sent to the tape-type paper sheet storing/feeding device.

Note that, in the paper sheet handling machine 10 according to the present embodiment, when the control unit 35 performs the control explained above, the paper sheet storing/feeding device as the transportation destination of the paper sheet is not limited to the tape-type paper sheet storing/feeding device including the drum 42 to the outer peripheral surface of which one end of each of the belt-shaped tapes 90, 92, 94 for winding a plurality of paper sheets one by one is connected. In a paper sheet handling machine 10 according to another embodiment, the control unit 35 can control the transport unit 20, based on the position of the cut part of the paper sheet detected by the first detecting unit 22*a*, so that the transportation destination of the paper sheet whose detection was performed by the first detecting unit 22*a* is switched between a paper sheet storing/feeding device having a configuration different from the tape-type paper sheet storing/feeding device (e.g., a stacker-type paper sheet storing/feeding device in which the paper sheets are stacked in a stacked manner such as the paper sheet storing and feeding units 30 and 32) and some other place.

As mentioned above, in the paper sheet handling machine 10 according to the present embodiment, when no cut part is present in the rear edge of the paper sheet in the transport direction of the paper sheet by the transport unit 20, the control unit 35 can control the transport unit 20 to transport the paper sheet whose detection was performed by the first detecting unit 22*a* to the paper sheet storing/feeding device. On the other hand, when the cut part is present in the rear edge of the paper sheet in the transport direction of the paper sheet by the transport unit 20, the control unit 35 can control the transport unit 20 to transport the paper sheet whose detection was performed by the first detecting unit 22*a* to some place other than the paper sheet storing/feeding device. In this case, when the cut part is present in the rear edge of the paper sheet in the transport direction of the paper sheet by the transport unit 20, the control unit 35 controls the transport unit 20 to transport the paper sheet, whose detection was performed by the first detecting unit 22*a*, to the orientation changing unit (specifically, the money depositing/dispensing unit 14) that changes the orientation of the paper sheet. The money depositing/dispensing unit 14 that functions as the orientation changing unit includes the second feeding mechanism 18 that feeds to the transport unit 20 the paper sheet sent to the money depositing/dispensing unit 14, and the orientation of the paper sheet is changed by returning the paper sheet, sent from the transport unit 20 to the money depositing/dispensing unit 14, to the transport unit 20 by the second feeding mechanism 18.

Moreover, as explained above, the control unit 35 controls the transport unit 20 so that the paper sheet, fed from the money depositing/dispensing unit 14 that functions as the orientation changing unit to the transport unit 20 by the second feeding mechanism 18, is transported to the first detecting unit 22*a*, causes the first detecting unit 22*a* to again detect the presence/absence of a cut part in the paper sheet, and transports the paper sheet, whose detection was performed by the first detecting unit 22*a*, to the paper sheet storing/feeding device if a cut part is not present in the rear edge of the paper sheet in the transport direction of the paper sheet by the transport unit 20.

Moreover, when the cut part is present in the rear edge of the paper sheet in the transport direction of the paper sheet by the transport unit 20, the control unit 35 controls the transport unit 20 to transport the paper sheet, whose detection was performed by the first detecting unit 22*a*, to the money depositing/dispensing unit 14 having an ejection opening for ejecting the paper sheet outside the body of the paper sheet handling machine 10. Then, the orientation of the paper sheet sent to the money depositing/dispensing unit 14 can be changed manually by the operator.

As mentioned above, in the paper sheet handling machine 10 according to the present embodiment, even when the cut part is present in the rear edge of the paper sheet in the transport direction of the paper sheet by the transport unit 20, if the position of the cut part in the width direction of the paper sheet matches with the position of one of the tapes 90, 92, 94 in the axial direction of the drum 42 of the paper sheet storing/feeding device (specifically, the escrow unit 40), the control unit 35 can control the transport unit 20 to transport the paper sheet whose detection was performed by the first detecting unit 22*a* to the paper sheet storing/feeding device. On the other hand, when the cut part is present in the rear edge of the paper sheet in the transport direction of the paper sheet by the transport unit 20, and if the position of the cut part in the width direction of the paper sheet does not match with the position of any of the tapes 90, 92, 94 in the axial direction of the drum 42 of the paper sheet storing/feeding device, the control unit 35 can control the transport unit 20 to transport the paper sheet whose detection was performed by the first detecting unit 22*a* to some place other than the paper sheet storing/feeding device.

Note that, the paper sheet handling machine 10 according to the present embodiment and/or the paper sheet storing/feeding device (specifically, the escrow unit 40) that is arranged in such a paper sheet handling machine 10 are not limited to the one having the configuration explained above, and various changes can be made in the configuration explained above.

For example, it is possible to omit from the recognition unit 22 the first detecting unit 22*a* that detects the cut part of the paper sheet transported by the transport unit 20, and instead, detect by using the second detecting unit 22*b* the position of the predetermined location in the width direction of the paper sheet (e.g., the position of the central portion in the width direction of the paper sheet) transported by the transport unit 20. In this configuration, based on the position of the predetermined location in the width direction of the paper sheet that is detected by the second detecting unit 22*b*, the control unit 35 controls the transport unit 20 so that the transportation destination of the paper sheet whose detection was performed by the second detecting unit 22*b* is switched between the paper sheet storing/feeding device (specifically, the escrow unit 40) and some other place. More particularly, when the position of the predetermined location in the width direction of the paper sheet (e.g., the position of the central portion in the width direction of the paper sheet) matches with the position of one of the tapes 90, 92, 94 in the axial direction of the drum 42 of the escrow unit 40 that functions as the paper sheet storing/feeding device, the control unit 35 controls the transport unit 20 to transport the paper sheet whose detection was performed by the second detecting unit 22*b* to the escrow unit 40. On the other hand, when the position of the predetermined location in the width direction of the paper sheet (e.g., the position of the central portion in the width direction of the paper sheet) does not match with the position of any of the tapes 90, 92, 94 in the axial direction of the drum 42 of the escrow unit 40, the control unit 35 controls the transport unit 20 to transport the paper sheet whose detection was performed by the second detecting unit 22*b* to some place (money depositing/dispensing unit 14) other than the escrow unit 40.

If the paper sheet inserted by the operator in the money depositing/dispensing unit 14 of the paper sheet handling machine 10 according to the present embodiment is in circulation in the market for a long time, such a paper sheet may be folded many times at the position of the central portion in the width direction of the paper sheet, and it is possible that a cut part is formed at this position. Even if the recognition unit 22 could not detect the cut part in itself formed in the paper sheet inserted in the housing 12 of the paper sheet handling machine 10, it is possible to estimate the position of the cut part that may be formed in the paper sheet by detecting the position of the central portion in the width direction of the paper sheet by using the second detecting unit 22*b* arranged in the recognition unit 22. That is, by detecting the position of the central portion in the width direction of the paper sheet transported by the transport unit 20 by using the second detecting unit 22*b*, it is assumed that the cut part has been formed at this position, and the transportation destination of this paper sheet can be switched between the escrow unit 40 and some place other than the escrow unit 40. In other words, even if the recognition unit 22 could not detect the cut part in itself formed in the paper sheet, by assuming that the cut part has been formed at the position of the central portion in the width direction of the paper sheet, among such paper sheets in which the cut part is formed in the position of the central portion in the width direction, the paper sheets in which the cut part does not match with the position of any of the tapes 90, 92, 94 in the axial direction of the drum 42 of the escrow unit 40 can be prevented from being sent to the escrow unit 40. Therefore, when the paper sheet is released near the guiding rollers 50 and 52 from the tapes 90, 92, 94, it is possible to prevent beforehand the issues that the paper sheet gets torn or the orientation of the paper sheet changes greatly near the place where the paper sheet is released from the tapes 90, 92, 94.

Moreover, when the paper sheet whose detection was performed by the second detecting unit 22*b* is transported to the money depositing/dispensing unit 14 instead of the escrow unit 40, this paper sheet can be returned from the money depositing/dispensing unit 14 to the transport unit 20 by the second feeding mechanism 18. When feeding the paper sheet from the money depositing/dispensing unit 14 to the transport unit 20 by the second feeding mechanism 18, it is possible that the position in the width direction of the paper sheet changes. Accordingly, when the paper sheet returned to the transport unit 20 is detected again by the second detecting unit 22*b*, it is possible that the position of the central portion in the width direction of the paper sheet matches with the position of one of the tapes 90, 92, 94 in the axial direction of the drum 42 of the escrow unit 40. In such instances, the paper sheet whose detection was performed by the second detecting unit 22*b* is transported to the escrow unit 40. Moreover, when the paper sheet whose detection was performed by the second detecting unit 22*b* is transported to the money depositing/dispensing unit 14, the operator can take out the paper sheet from the money depositing/dispensing unit 14 and insert the paper sheet into the money depositing/dispensing unit 14 again while shifting the position in the width direction of the paper sheet so that the paper sheet is fed to the transport unit 20 by the first feeding mechanism 16. When such operation is performed, the position of the paper sheet, fed to the transport unit 20 by the first feeding mechanism 16, in the width direction of the paper sheet changes. Accordingly, when the paper sheet returned to the transport unit 20 is detected again by the second detecting unit 22*b*, it is possible that the position of the central portion in the width direction of the paper sheet matches with the position of one of the tapes 90, 92, 94 in the axial direction of the drum 42 of the escrow unit 40.

Moreover, when the money deposition process of the banknote is performed in the paper sheet handling machine 10 according to the present embodiment, it is allowable to store the banknote recognized by the recognition unit 22 directly in one of the paper sheet storing and feeding units 30 instead of sending the banknote to the escrow unit 40. In this configuration, when the banknote fed to the transport unit 20 from the money depositing/dispensing unit 14 by the first feeding mechanism 16 is recognized by the recognition unit 22, the face side up/back side up of the banknote is detected by the third detecting unit 22*c* arranged in the recognition unit 22. Moreover, based on the face side up/back side up information of the banknote detected by the third detecting unit 22*c*, the control unit 35 can control the transport unit 20 so that the transportation destination of the banknote whose detection was performed by the third detecting unit 22*c* is switched between one of the paper sheet storing and feeding units 30 and some other place (e.g., the money depositing/dispensing unit 14). More particularly, when the banknotes handled by the paper sheet handling machine 10 includes 50000-Won banknotes issued by the Republic of Korea and 100-dollar banknotes issued by the United States, the above processing is performed by using the third detecting unit 22*c*. A belt-shaped 3D security ribbon is formed on the surface of the 100-dollar banknotes for forgery prevention, and a partial exposed three-dimensional silver line is formed on the surface of the 50000-Won banknotes also for forgery prevention (e.g., see FIG. 6A of Japanese Patent No. 5508990). When such banknotes, on a surface of which the forgery prevention member having the 3D structure is formed, are stored in a stacked manner in the paper sheet storing and feeding units 30, and when, among the banknotes that have been previously stacked in the paper sheet storing and feeding units 30, the surface of the topmost banknote on which the forgery prevention member has been formed is facing up, the next banknote that needs to be stacked in one of the paper sheet storing and feeding units 30 may get caught in the forgery prevention member of the topmost banknote that has been previously stacked, and this banknote cannot be stacked in that paper sheet storing and feeding unit 30. When this happens, there is a possibility of occurrence of jamming and the like. Therefore, when the banknote that should be sent from the transport unit 20 to one of the paper sheet storing and feeding units 30 is recognized by the recognition unit 22, if it is detected by the third detecting unit 22*c* that the forgery prevention member formed on this banknote is facing up, this banknote, instead of stacking in one of the paper sheet storing and feeding units 30, is sent, for example, to the money depositing/dispensing unit 14. Moreover, because the surfaces of the banknotes, which have been sent to the money depositing/dispensing unit 14, on which the forgery prevention member has been formed are facing in the same direction, there is no chance of occurrence of the stacking failure of the banknotes in the money depositing/dispensing unit 14.

Moreover, when the banknote is returned from the money depositing/dispensing unit 14 to the transport unit 20 by the second feeding mechanism 18 after the banknote whose detection was performed by the third detecting unit 22*c* is sent to the money depositing/dispensing unit 14, the face side up/back side up of this banknote is changed. In this manner, a face side up/back side up changing unit that changes the face side up/back side up of the banknote whose detection was performed by the third detecting unit 22*c* is constituted by the transport unit 20 and the money depositing/dispensing unit 14. When a direction of the face side up/back side up of the banknote detected by the third detecting unit 22*c* is not a predetermined direction, the control unit 35 controls the transport unit 20 and the money depositing/dispensing unit 14 so that the face side up/back side up of the banknote whose detection was performed by the third detecting unit 22*c* is changed by the face side up/back side up changing unit (specifically, the transport unit 20 and the money depositing/dispensing unit 14). The control unit 35 controls the transport unit 20 so as to transport the banknote whose face side up/back side up has been changed by the face side up/back side up changing unit to the third detecting unit 22*c*, causes the third detecting unit 22*c* to again detect the face side up/back side up of the banknote, and transport the banknote, whose detection was performed by the third detecting unit 22*c*, to one of the paper sheet storing and feeding units 30 if the direction of the face side up/back side up of the banknote detected by the third detecting unit 22*c* has become the predetermined direction. In this manner, when a direction of the face side up/back side up of the banknote detected by the third detecting unit 22*c* is not the predetermined direction (specifically, when the forgery prevention member of the banknote faces up when the banknote is stacked in one of the paper sheet storing and feeding units 30), the face side up/back side up of the banknote is changed by the face side up/back side up changing unit. Accordingly, the banknotes can be stacked in the paper sheet storing and feeding units 30 with the forgery prevention member facing down, so that the jamming of the banknote can be prevented from occurring in the paper sheet storing and feeding units 30.

Figure 20:
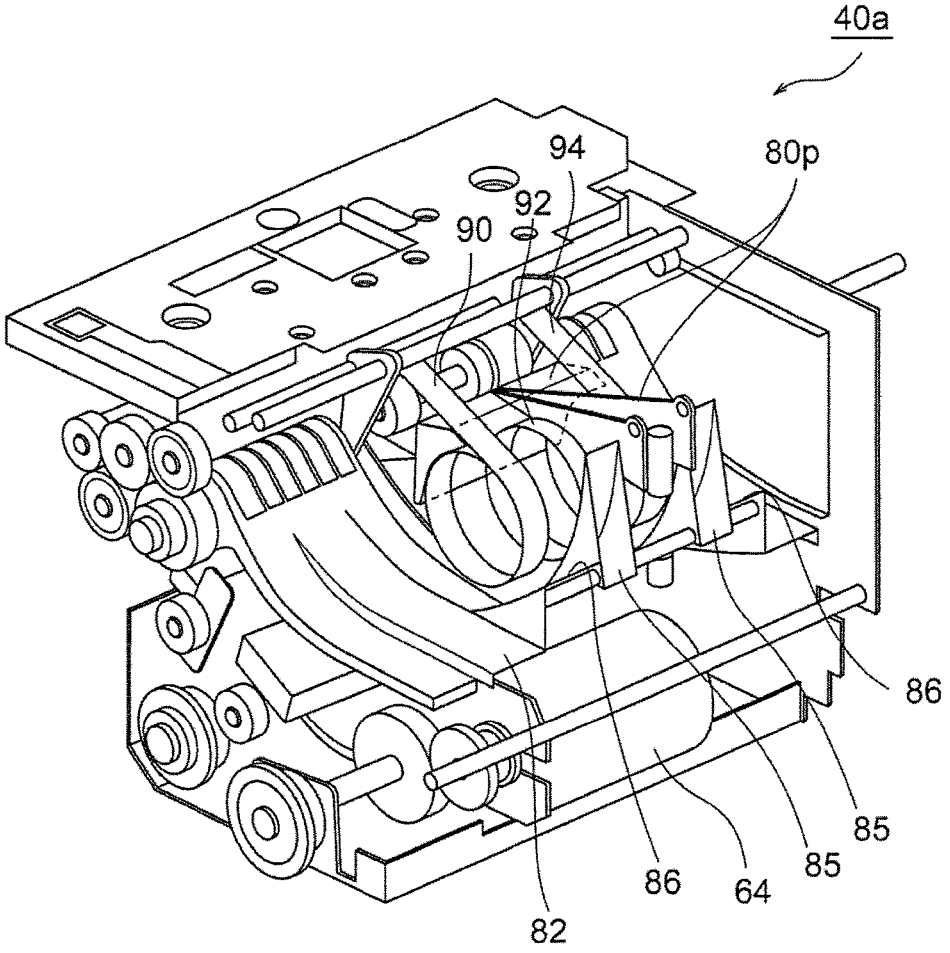
FIG. 20 is a perspective view of a configuration of an escrow unit according to a variation.
Figure 21:
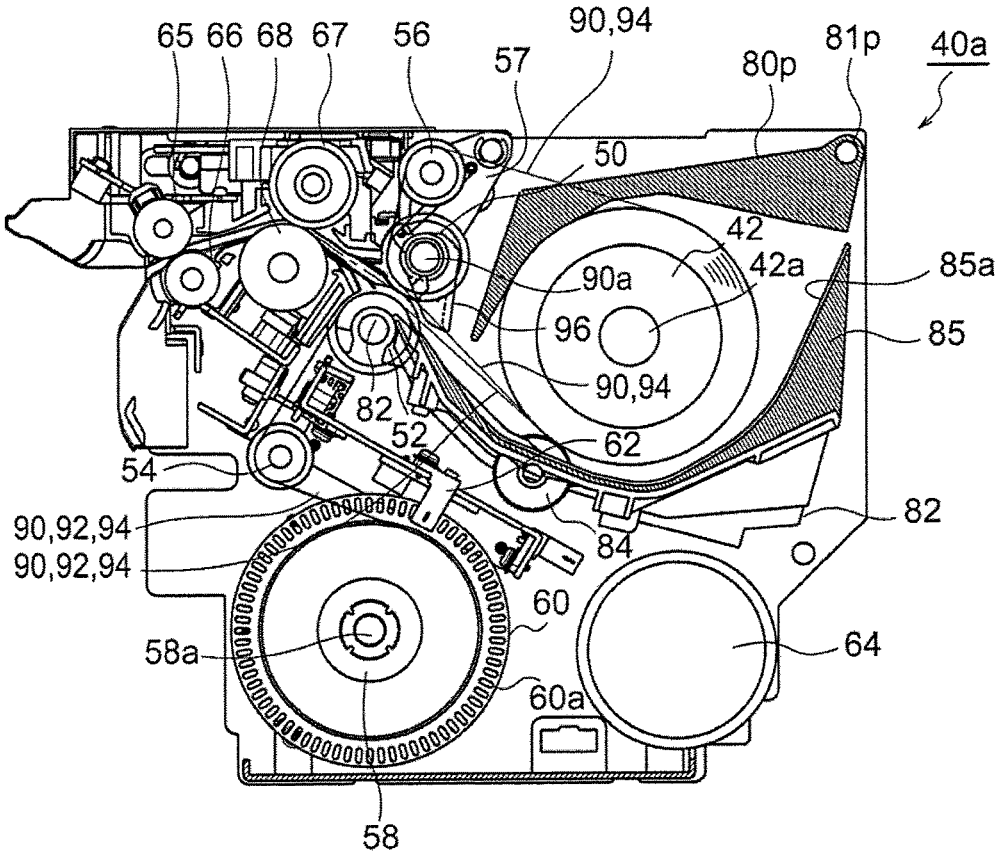
FIG. 21 is a side view of a detailed configuration of the escrow unit shown in FIG. 20.

Moreover, the paper sheet storing/feeding device (specifically, the escrow unit) arranged in the paper sheet handling machine 10 according to the present embodiment is not limited to the one having the configuration shown in FIGS. 2 to 15. As the tape-type paper sheet storing/feeding device in which the paper sheets such as the banknotes are stored one by one on the rotary member such as the drum and the paper sheets are fed one by one from the rotary member, an escrow unit 40*a* having the configuration shown in FIGS. 20 and 21 can be used. A configuration of only a guiding unit 80*p* of the escrow unit 40*a* shown in FIGS. 20 and 21 is different from the guiding unit 80 of the escrow unit 40 shown in FIGS. 2 to 15, and the remaining configuration of the escrow unit 40*a* is almost the same as that of the escrow unit 40 shown in FIGS. 2 to 15. Therefore, in the explanation of the escrow unit 40*a* shown in FIGS. 20 and 21, the same reference numerals have been assigned to the components that are the same as those of the escrow unit 40 shown in FIG. 2 to FIG. 15, and the explanation thereof has been omitted.

The escrow unit 40*a* shown in FIGS. 20 and 21 includes the guiding unit 80*p* whose tip part covers all the three tapes 90, 92, 94. The guiding unit 80*p* is arranged above the drum 42. Note that, the drum 42 has been omitted from FIG. 20 to facilitate the understanding of the positional relationship of the guiding unit 80*p* and the tapes 90, 92, 94. The guiding unit 80*p* is rotatable around an axis 81*p* that extends parallel to the axis 42*a* of the drum 42. A tip part of the guiding unit 80*p* touches the tapes 90, 92, 94 wound on the drum 42 by the weight of the guiding unit 80*p*. Note that, instead of the tip part of the guiding unit 80*p* touching the tapes 90, 92, 94 wound on the drum 42 by the weight of the guiding unit 80*p*, it is allowable that the tip part of the guiding unit 80*p* is biased towards the drum 42 by a not-shown biasing unit such as a spring. Because the guiding unit 80*p* having such a configuration is arranged opposite to the tapes 90, 92, 94 so as to be in contact with a surface of the tapes 90, 92, 94, even if a folded part of the paper sheet tries to ride on the surface of the tapes 90, 92, 94 when the paper sheet is fed from the drum 42 while the tapes 90, 92, 94 are unwound from the drum 42, it is inhibited that the folded part rides on the surface of the tapes 90, 92, 94 as the folded part of this paper sheet contacts the guiding unit 80*p*. Therefore, it is prevented that the folded paper sheet sandwiches the tapes 90, 92, 94 from both sides.

Moreover, as shown in FIG. 20, the tip part of the guiding unit 80*p* is arranged below the tapes 90 and 94 that move between the drum 42 and the guiding rollers 56. The tip part of the guiding unit 80*p* is arranged with a small gap opposite to the tapes 90 and 94 that move between the drum 42 and the guiding rollers 56. In this manner, in the escrow unit 40*a* shown in FIGS. 20 and 21, the guiding unit 80*p* and the guiding units 85 are arranged on both the sides of the tapes 90 and 94 that are sent from the guiding rollers 56 to the drum 42 when the paper sheet is fed from 42 as the drum 42 rotates in the clockwise direction in FIG. 21. In this configuration, even when the paper sheet gets folded when the paper sheet is fed from the drum 42, it is prevented more surely by the guiding units 80*p* and 85 that this folded paper sheet sandwiches the tapes 90 and 94 from both sides. Therefore, it is prevented more surely that the paper sheet gets torn or the orientation of the paper sheet changes greatly near the place (specifically, the guiding rollers 50, 52) where the paper sheet is released from the tapes 90 and 94.

Figure 22:
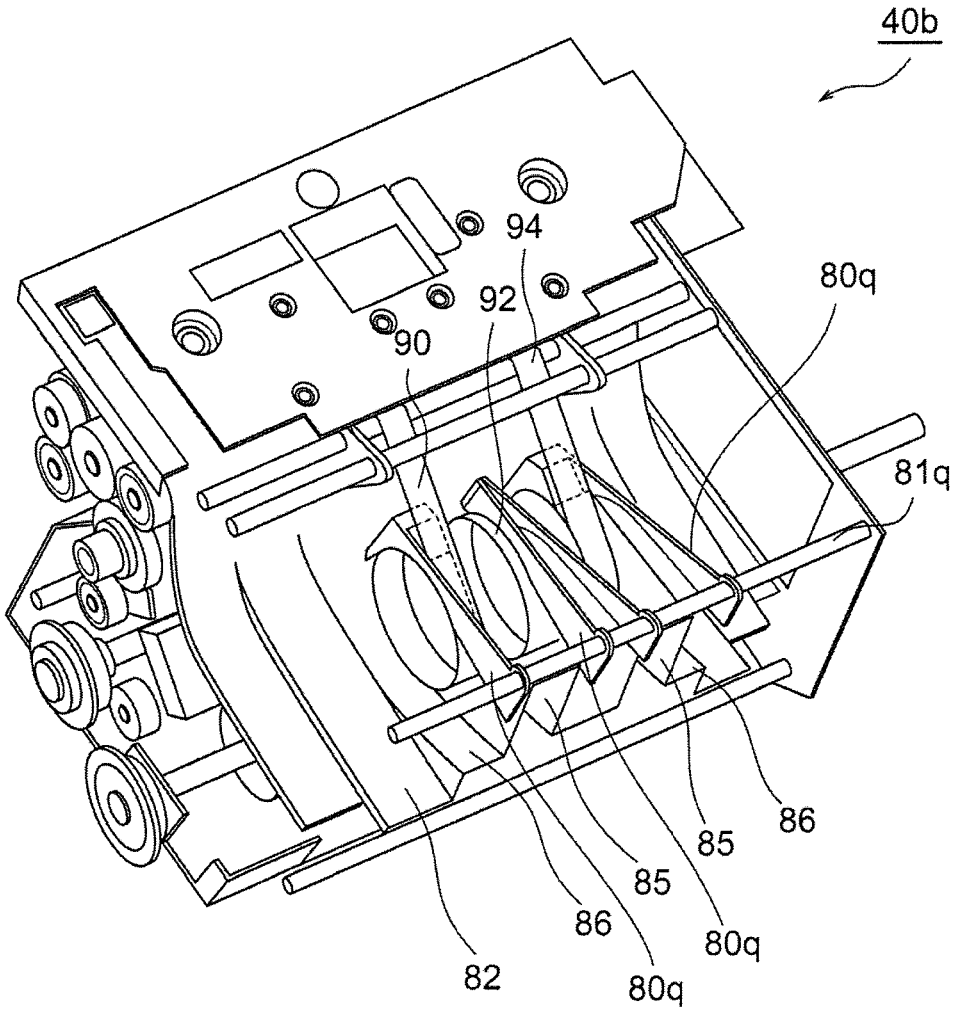
FIG. 22 is a perspective view of a configuration of an escrow unit according to another variation.

As the tape-type paper sheet storing/feeding device in which the paper sheets such as the banknotes are stored one by one on the rotary member such as the drum and the paper sheets are fed one by one from the rotary member, an escrow unit 40*b* having the configuration shown in FIG. 22 can be used. A configuration of the escrow unit 40*b* shown in FIG. 22 is different from the guiding unit 80 of the escrow unit 40 shown in FIGS. 2 to 15 in that a plurality (specifically, three) of guiding units 80*q* is arranged corresponding to the tapes 90, 92, 94, and the remaining configuration of the escrow unit 40*b* is almost the same as that of the escrow unit 40 shown in FIGS. 2 to 15. Therefore, in the explanation of the escrow unit 40*b* shown in FIG. 22, the same reference numerals have been assigned to the components that are the same as those of the escrow unit 40 shown in FIGS. 2 to 15, and the explanation thereof has been omitted.

The escrow unit 40*b* shown in FIG. 22 includes three guiding units 80*q* corresponding to the three tapes 90, 92, 94. The guiding units 80*q* are arranged above the drum 42. Note that, the drum 42 has been omitted from FIG. 22 to facilitate the understanding of the positional relationship of the guiding units 80*q* and the tapes 90, 92, 94. The guiding units 80*q* are rotatable around an axis 81*q* that extends parallel to the axis 42*a* of the drum 42. A tip part of the guiding units 80*q* touches the tapes 90, 92, 94 wound on the drum 42 by the weight of the guiding units 80*q*. Note that, instead of the tip parts of the guiding units 80*q* touching the tapes 90, 92, 94 wound on the drum 42 by the weight of the guiding units 80*q*, it is allowable that the tip parts of the guiding units 80*q* are biased towards the drum 42 by a not-shown biasing unit such as a spring. Because the guiding units 80*q* having such a configuration are arranged opposite to the tapes 90, 92, 94 so as to be in contact with a surface of the tapes 90, 92, 94, even if a folded part of the paper sheet tries to ride on the surface of the tapes 90, 92, 94 when the paper sheet is fed from the drum 42 while the tapes 90, 92, 94 are unwound from the drum 42, it is inhibited that the folded part rides on the surface of the tapes 90, 92, 94 as the folded part of this paper sheet contacts the guiding units 80*q*. Therefore, it is prevented that the folded paper sheet sandwiches the tapes 90, 92, 94 from both sides.

Moreover, as shown in FIG. 22, the tip part of the guiding units 80*q* corresponding to the tapes 90 and 94 is arranged below the tapes 90 and 94 that move between the drum 42 and the guiding rollers 56. The tip part of the guiding units 80*q* is opposed with the tapes 90 and 94 with a small gap between the tapes 90 and 94 that move between the drum 42 and the guiding rollers 56. In this manner, in the escrow unit 40*b* shown in FIG. 22, like in the escrow unit 40*a* shown in FIGS. 20 and 21, the guiding units 80*q* and the guiding units 85 are arranged on both the sides of the tapes 90 and 94 that are sent from the guiding rollers 56 to the drum 42 when the paper sheet is fed from the drum 42. In this configuration, even when the paper sheet gets folded while the paper sheet is fed from the drum 42, it is prevented more surely by the guiding units 80*q* and 85 that the folded paper sheet sandwiches the tapes 90 and 94 from both sides. Therefore, it is prevented more surely that the paper sheet gets torn or the orientation of the paper sheet changes greatly near the place (specifically, near the guiding rollers 50 and 52) where the paper sheet is released from the tapes 90 and 94.

Figure 23:
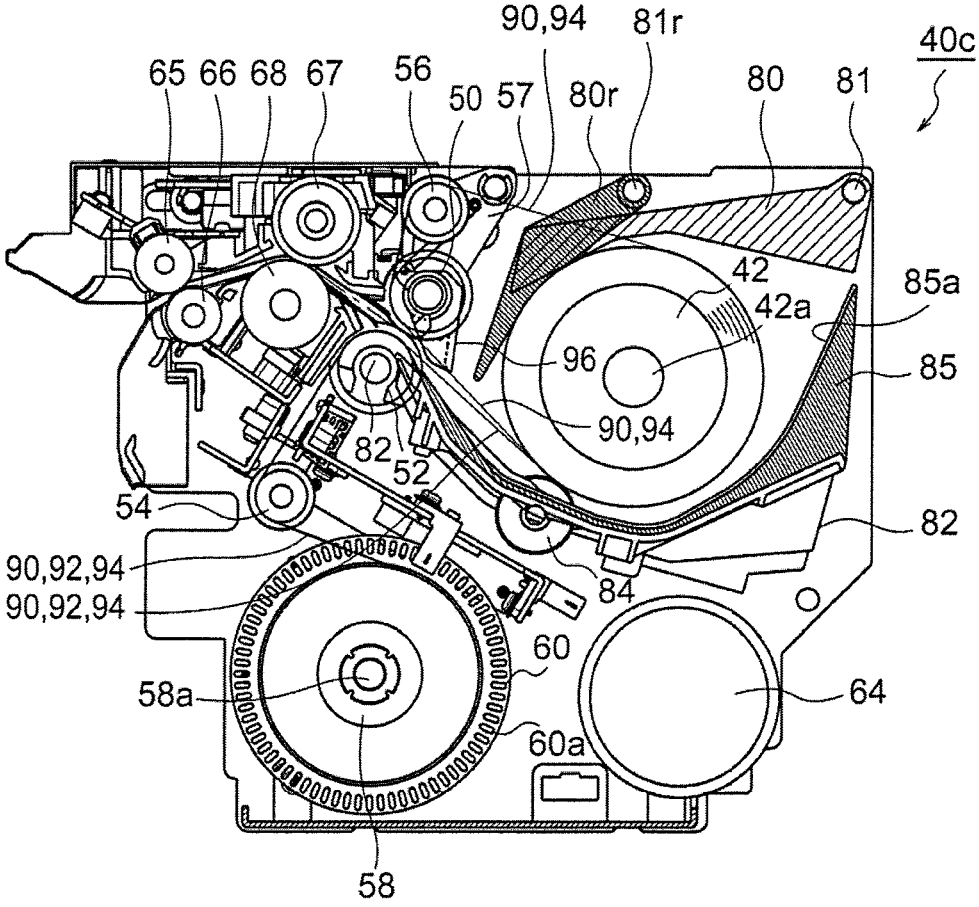
FIG. 23 is a side view of a configuration of an escrow unit according to still another variation.

As the tape-type paper sheet storing/feeding device in which the paper sheets such as the banknotes are stored one by one on the rotary member such as the drum and the paper sheets are fed one by one from the rotary member, an escrow unit 40*c* having the configuration shown in FIG. 23 can be used. A configuration of the escrow unit 40*c* shown in FIG. 23 is different from the escrow unit 40 shown in FIGS. 2 to 15 in that a plurality of guiding units 80*r* is further arranged corresponding to the tapes 90 and 94, and the remaining configuration of the escrow unit 40*c* is almost the same as that of the escrow unit 40 shown in FIGS. 2 to 15. Therefore, in the explanation of the escrow unit 40*c* shown in FIG. 23, the same reference numerals have been assigned to the components that are the same as those of the escrow unit 40 shown in FIGS. 2 to 15, and the explanation thereof has been omitted.

In the escrow unit 40*c* shown in FIG. 23, the guiding unit 80 is installed above the drum 42 corresponding to the central tape 92 like in the escrow unit 40 shown in FIGS. 2 to 15. The guiding unit 80 is rotatable around the axis 81 that extends parallel to the axis 42*a* of the drum 42. The tip part of the guiding unit 80 touches the tape 92 wound on the drum 42 by the weight of the guiding unit 80. Moreover, a position of the guiding unit 80 in the axial direction of the drum 42 (i.e., a position in a direction that is orthogonal to the paper on which FIG. 23 is printed) is opposite to the tape 92. The escrow unit 40*c* shown in FIG. 23 includes two guiding units 80*r* corresponding to the side tapes 90 and 94. The guiding units 80*r* are arranged above the drum 42 (note that, though only one guiding unit 80*r* has been shown in FIG. 23, actually, two guiding units 80*r* are arranged side by side in the direction that is orthogonal to the paper on which FIG. 23 is printed). The guiding units 80*r* are rotatable around an axis 81*r* arranged towards left of the axis 81 in FIG. 23. A tip part of the guiding units 80*r* touches the tapes 90 and 94 wound on the drum 42 by the weight of the guiding units 80*r*. Note that, instead of the tip parts of the guiding units 80*r* touching the tapes 90 and 94 wound on the drum 42 by the weight of the guiding units 80*r*, it is allowable that the tip parts of the guiding units 80*r* are biased towards the drum 42 by a not-shown biasing unit such as a spring. Because the guiding units 80*r* having such a configuration are arranged opposite to the tapes 90 and 94 so as to be in contact with a surface of the tapes 90 and 94, even if a folded part of the paper sheet tries to ride on the surface of the tapes 90 and 94 when the paper sheet is fed from the drum 42 while the tapes 90 and 94 are unwound from the drum 42, it is inhibited that the folded part rides on the surface of the tapes 90 and 94 as the folded part of this paper sheet contacts the guiding units 80*r*. Therefore, it is prevented that the folded paper sheet sandwiches the tapes 90 and 94 from both sides.

Figure 24:
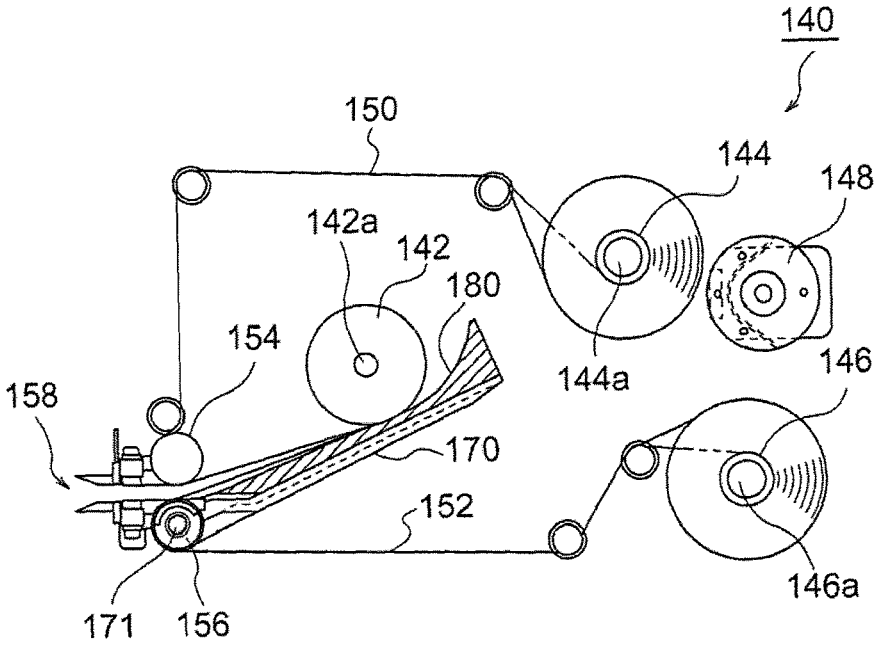
FIG. 24 is a side view of a configuration of a paper sheet storing/feeding device according to still another variation.
Figure 25:
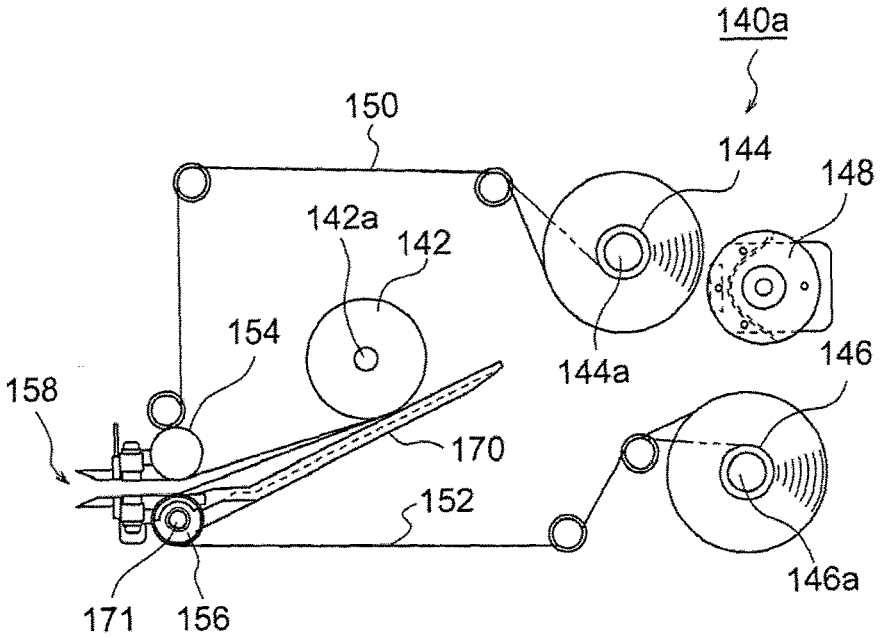
FIG. 25 is a side view of a configuration of a conventional paper sheet storing/feeding device as a comparative example.

As the tape-type paper sheet storing/feeding device in which the paper sheets such as the banknotes are stored one by one on the rotary member such as the drum and the paper sheets are fed one by one from the rotary member, a device having the configuration shown in FIG. 24 can be used. Note that, FIG. 24 is a side view of a configuration of a paper sheet storing/feeding device 140 according to the present invention, and FIG. 25 is a side view of a configuration of a conventional paper sheet storing/feeding device 140*a* as a comparative example.

As shown in FIG. 24, the paper sheet storing/feeding device 140 according to the present invention is a tape type in which a plurality of the paper sheets is stored one by one on a drum 142 by winding a pair of belt-shaped tapes 150 and 152 on the drum 142 in a state that the paper sheets are sandwiched between the tapes 150 and 152, and the paper sheets are unwound from the drum 142 by unwinding the tapes 150 and 152 from the drum 142. Specifically, the paper sheet storing/feeding device 140 includes the rotatable drum 142, the belt-shaped tapes 150 and 152 whose one ends are connected to an outer peripheral surface of the drum 142, a rotatable first tape reel 144 to an outer peripheral surface of which the other end of the tape 150 is connected among the belt-shaped tapes 150 and 152, and a rotatable second tape reel 146 to an outer peripheral surface of which the other end of the tape 152 is connected among the belt-shaped tapes 150 and 152.

The drum 142 can rotate around an axis 142*a* in both a clockwise direction and a counterclockwise direction in FIG. 24. Specifically, when storing on the drum 142 the paper sheet sent inside the paper sheet storing/feeding device 140 from a port 158 from the outside of the paper sheet storing/feeding device 140, the drum 142 is rotated in the counterclockwise direction in FIG. 24 so that the paper sheet sent from the port 158 to between the belt-shaped tapes 150 and 152 is wound on the drum 142 along with the tapes 150 and 152 in the state that the paper sheet is sandwiched between the tapes 150 and 152. On the other hand, when feeding the paper sheet stored on the drum 142 to the outside of the paper sheet storing/feeding device 140 from the port 158, the drum 142 is rotated in the clockwise direction in FIG. 24 to unwind the tapes 150 and 152 from the drum 142 so that the paper sheet sandwiched between the tapes 150 and 152 is released from the tapes 150 and 152 and sent to the port 158.

Moreover, as shown in FIG. 24, a drive motor 148 that rotationally drives the drum 142 is arranged. More particularly, a not-shown pulley is arranged on a rotation axis of the drive motor 148, and a not-shown drive belt is looped over the pulley. Moreover, a not-shown pulley is arranged on the axis 142*a* of the drum 142, and a not-shown drive belt is looped over the pulley. Accordingly, when the drive motor 148 rotationally drives the drive belt, the driving force of the drive motor 148 is conveyed to the axis 142*a* via the drive belt, and the drum 142 is rotationally driven.

The other end of the tape 150 among the belt-shaped tapes 150 and 152 is connected to the outer peripheral surface of the first tape reel 144, and the tape 150 can be wound on the first tape reel 144. The first tape reel 144 can rotate around an axis 144*a* in both the clockwise direction and the counterclockwise direction in FIG. 24. The tape 150 is wound on the first tape reel 144 when the first tape reel 144 is rotated in the counterclockwise direction in FIG. 24, and the tape 150 is unwound from the first tape reel 144 when the first tape reel 144 is rotated in the clockwise direction in FIG. 24.

The other end of the tape 152 among the belt-shaped tapes 150 and 152 is connected to the outer peripheral surface of the second tape reel 146, and the tape 152 can be wound on the second tape reel 146. The second tape reel 146 can rotate around an axis 146*a* in both the clockwise direction and the counterclockwise direction in FIG. 24. The tape 152 is wound on the second tape reel 146 when the second tape reel 146 is rotated in the clockwise direction in FIG. 24, and the tape 152 is unwound from the second tape reel 146 when the second tape reel 146 is rotated in the counterclockwise direction in FIG. 24.

Moreover, near the port 158 of the paper sheet storing/feeding device 140 are arranged a guiding roller 154 that guides the tape 150 and a guiding roller 156 that guides the tape 152. The guiding rollers 154 and 156 are arranged opposite to each other with a small gap therebetween. The paper sheet sent inside the paper sheet storing/feeding device 140 from the port 158 from the outside of the paper sheet storing/feeding device 140 first passes between the guiding rollers 154 and 156, and then is sandwiched between the tapes 150 and 152 and wound on the drum 142.

Moreover, as shown in FIG. 24, a movable guide 170 is arranged below the drum 142. The movable guide 170 rotates around an axis 171 that is arranged coaxially with an axis of the guiding roller 156. Moreover, a biasing unit such as a spring that biases the movable guide 170 in the counterclockwise direction in FIG. 24 around the axis 171 is arranged. The movable guide 170 is biased in the counterclockwise direction in FIG. 24 around the axis 171 by the biasing unit. Because such a movable guide 170 is provided, the paper sheet sent inside the paper sheet storing/feeding device 140 from the port 158 from the outside of the paper sheet storing/feeding device 140 first passes between the guiding rollers 154 and 156, and is then appropriately wound on the drum 142 along with the tapes 150 and 152 while being guided by the movable guide 170.

Moreover, as shown in FIG. 24, a guiding unit 180 is arranged opposite to the tapes 150 and 152 in the movable guide 170. Even if the paper sheet gets folded while the paper sheet is fed from the drum 142, the guiding unit 180 prevents the folded paper sheet from sandwiching the tapes 150 and 152 from both sides. A position of the guiding unit 180 in the axial direction of the drum 142 (a position in a direction orthogonal to the paper on which FIG. 24 is printed) is opposite to the tapes 150 and 152 (more specifically, the tape 152). The guiding unit 180 is shown with hatching in FIG. 24.

Moreover, the guiding unit 180 has a shape such that both the side edges thereof circumferentially extend along the drum 142 with a constant width in the axial direction of the drum 142 in a direction in which the paper sheet is fed from the drum 142. Note that, the guiding unit 180 can have a shape that widens in an outer width direction of the tapes 150 and 152 as one advances from the drum 142 in the direction in which the paper sheet is fed. Moreover, the guiding unit 180 is arranged so as to bend towards the drum 142 from a guide surface of the movable guide 170 that guides the paper sheet. A guide surface of the guiding unit 180 is opposed to the tapes 150 and 152 so as to touch the surface of the tape 152 among the tapes 150 and 152 wound on the drum 142. The movable guide 170 to which the guiding unit 180 has been attached is pivotable around the axis 171 depending on the quantity of the paper sheets stored on the drum 142. Because the movable guide 170 is pushed in the counterclockwise direction in FIG. 24 around the axis 171 by the biasing unit such as the spring, irrespective of whether the quantity of the paper sheets stored on the drum 142 is large or small, the guiding unit 180 touches the surface of the tape 152 among the tapes 150 and 152 wound on the drum 142. Because the guiding unit 180 having such a configuration is arranged opposite to the tapes 150 and 152, even if a folded part of the paper sheet tries to ride on the surface of the tapes 150 and 152 when the paper sheet is fed from the drum 142 while the tapes 150 and 152 are unwound from the drum 142, it is inhibited that the folded part rides on the surface of the tapes 150 and 152 as the folded part of this paper sheet contacts a side surface of the guiding unit 180. Therefore, it is prevented that the folded paper sheet sandwiches the tapes 150 and 152 from both sides.

On the other hand, as shown in FIG. 25, such a guiding unit 180 is not arranged in the conventional paper sheet storing/feeding device 140*a* as the comparative example. In this manner, in the conventional paper sheet storing/feeding device 140*a* in which the guiding unit 180 is not arranged, when the paper sheet fed from the drum 142 as the tapes 150 and 152 are unwound from the drum 142 has a cut part in a front edge of the paper sheet in a feeding direction of the paper sheet, and when a part of the paper sheet gets folded at the cut part, the folded part of the paper sheet may touch a back surface of the tape 150 or the tape 152 and the folded paper sheet may sandwich the tape 150 and/or the tape 152 from both sides. When this happens, when the paper sheet is released near the guiding rollers 154 and 156 from the tapes 150 and 152, the part of the paper sheet that got folded in the tape 150 and/or the tape 152 may be sandwiched between the tapes 150 and 152 and the guiding roller 154 and the guiding roller 156, and the paper sheet may be torn from the cut part or the orientation of the paper sheet may change greatly.

In this manner, the paper sheet storing/feeding device 140 shown in FIG. 24, like the escrow unit 40 shown in FIGS. 2 to 15, is provided with the guiding unit 180 to guide the paper sheet to prevent the paper sheet from sandwiching the tape 150 and/or the tape 152 from both sides when the paper sheet is fed from the drum 142 by unwinding the tapes 150 and 152 from the drum 142. Because such a guiding unit 180 is provided, when the paper sheet is folded while the paper sheet is fed from the drum 142, it is prevented by the guiding unit 180 that the folded paper sheet sandwiches the tape 150 and/or the tape 152 from both sides. Therefore, it is prevented that the paper sheet gets torn or the orientation of the paper sheet changes greatly near the place (specifically, near the guiding rollers 154 and 156) where the paper sheet is released from the tapes 150 and 152.

Figure 26:
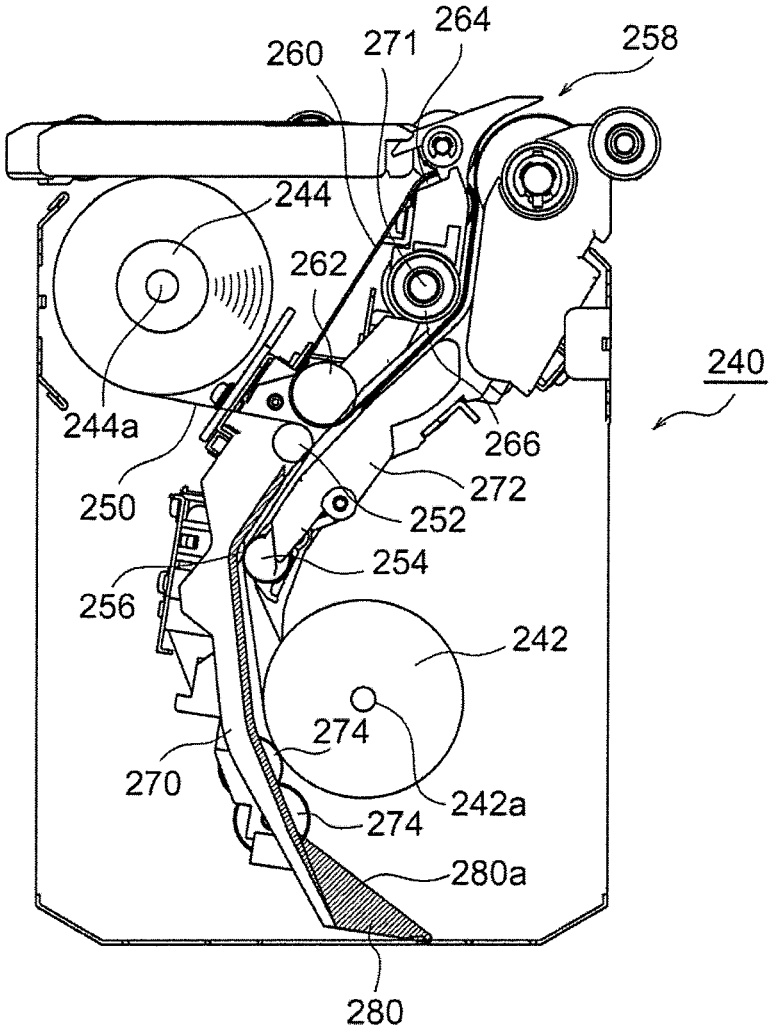
FIG. 26 is a side view of a configuration of a paper sheet storing/feeding device according to still another variation.
Figure 27:
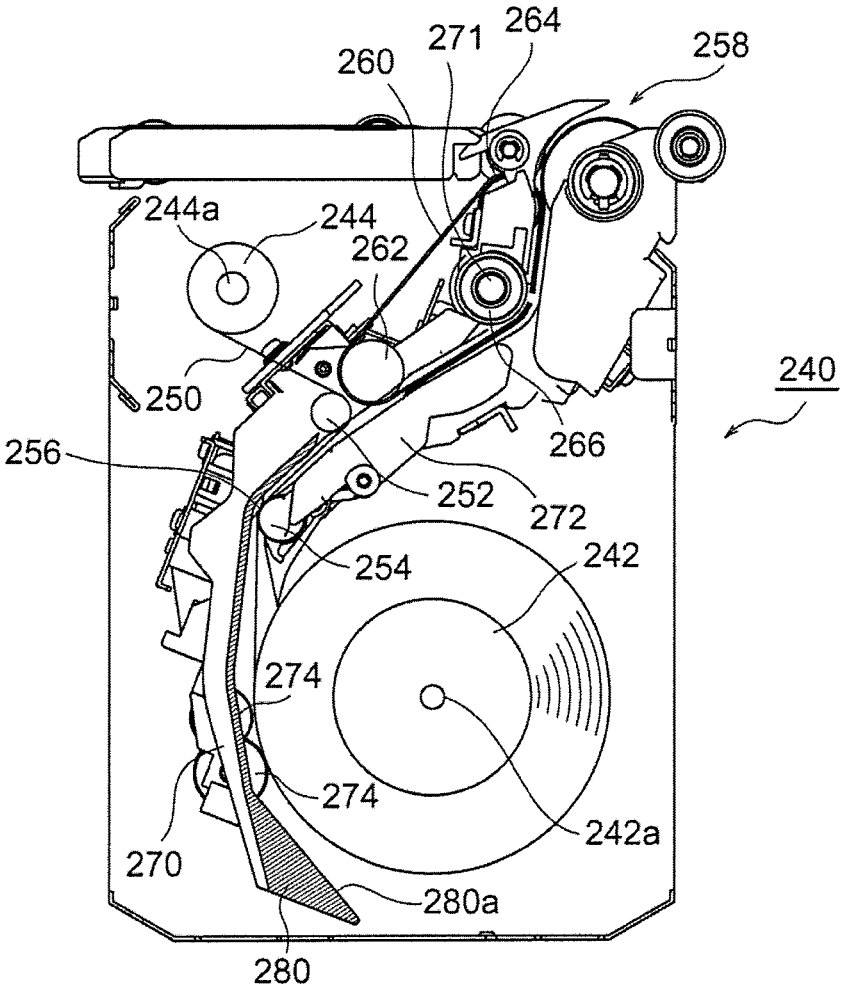
FIG. 27 is a side view of a configuration of a paper sheet storing/feeding device according to still another variation.
Figure 28:
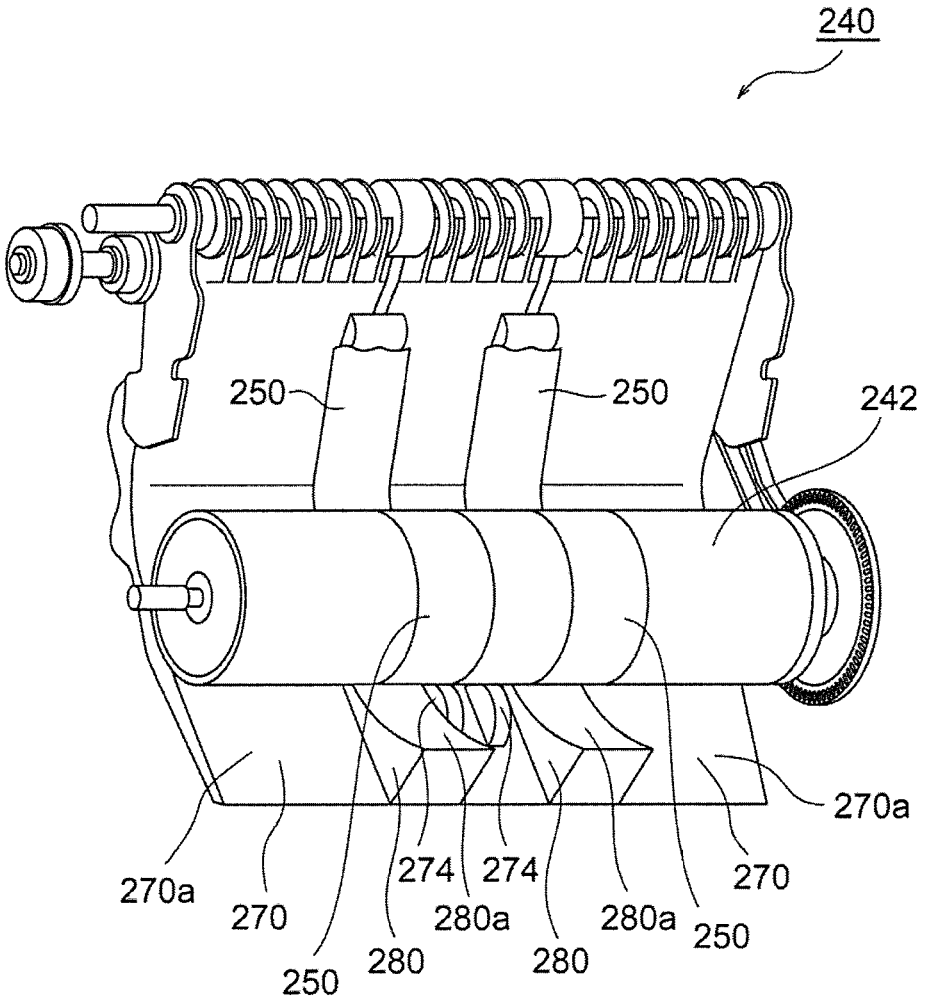
FIG. 28 is a perspective view of a configuration of the paper sheet storing/feeding device shown in FIGS. 26 and 27.
Figure 29:
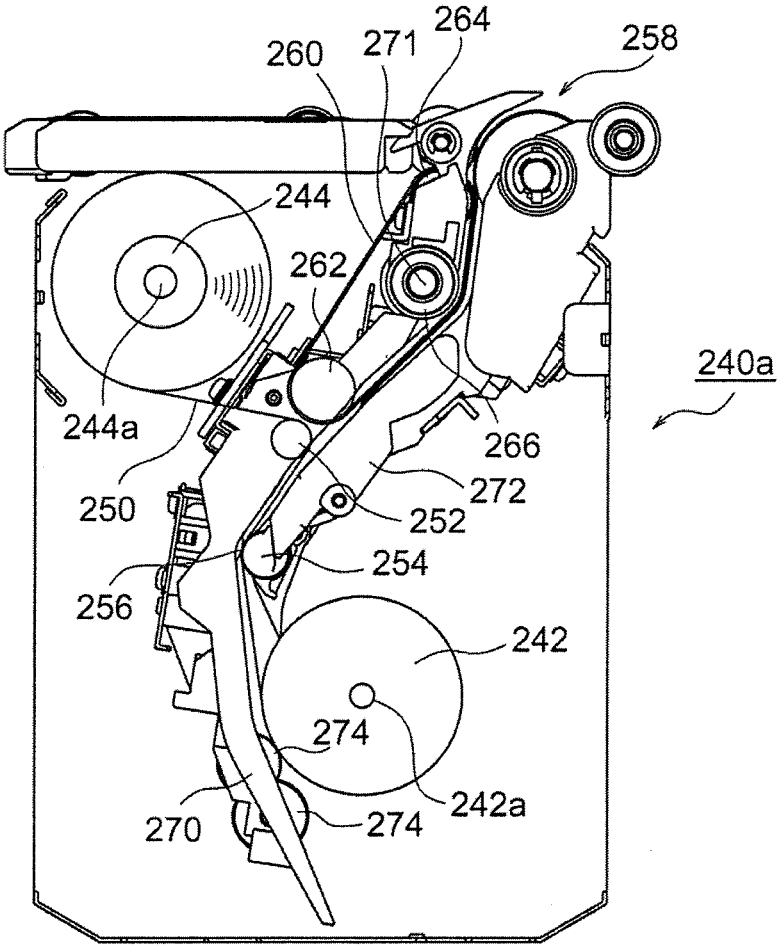
FIG. 29 is a side view of a configuration of the conventional paper sheet storing/feeding device as a comparative example.
Figure 30:
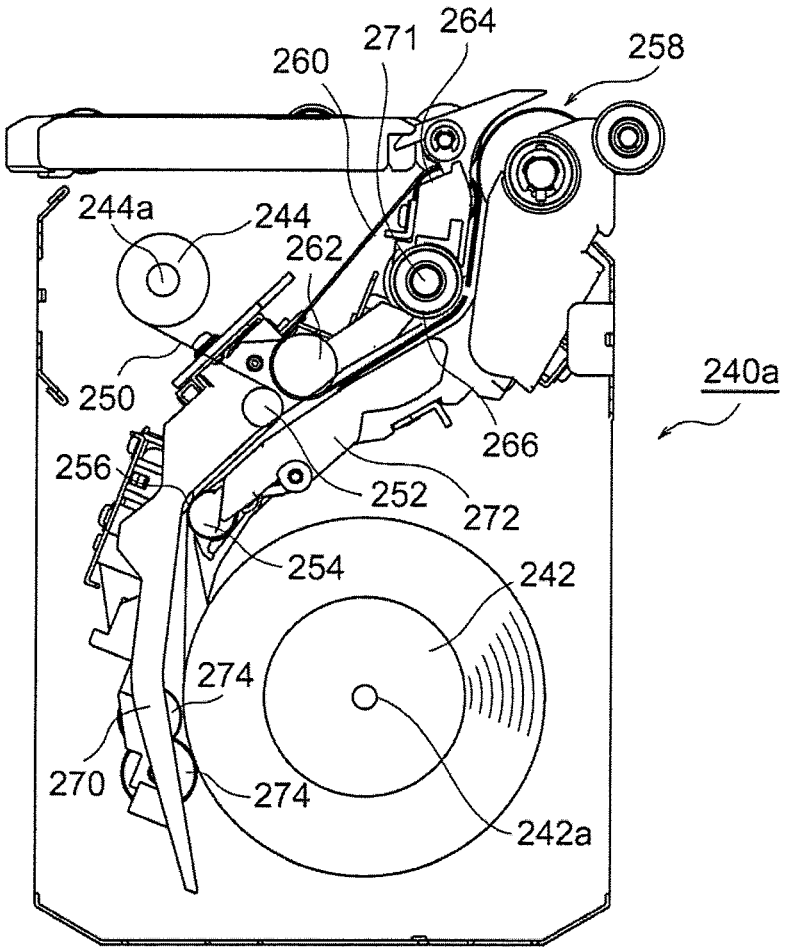
FIG. 30 is a side view of a configuration of the conventional paper sheet storing/feeding device as a comparative example.
Figure 31:
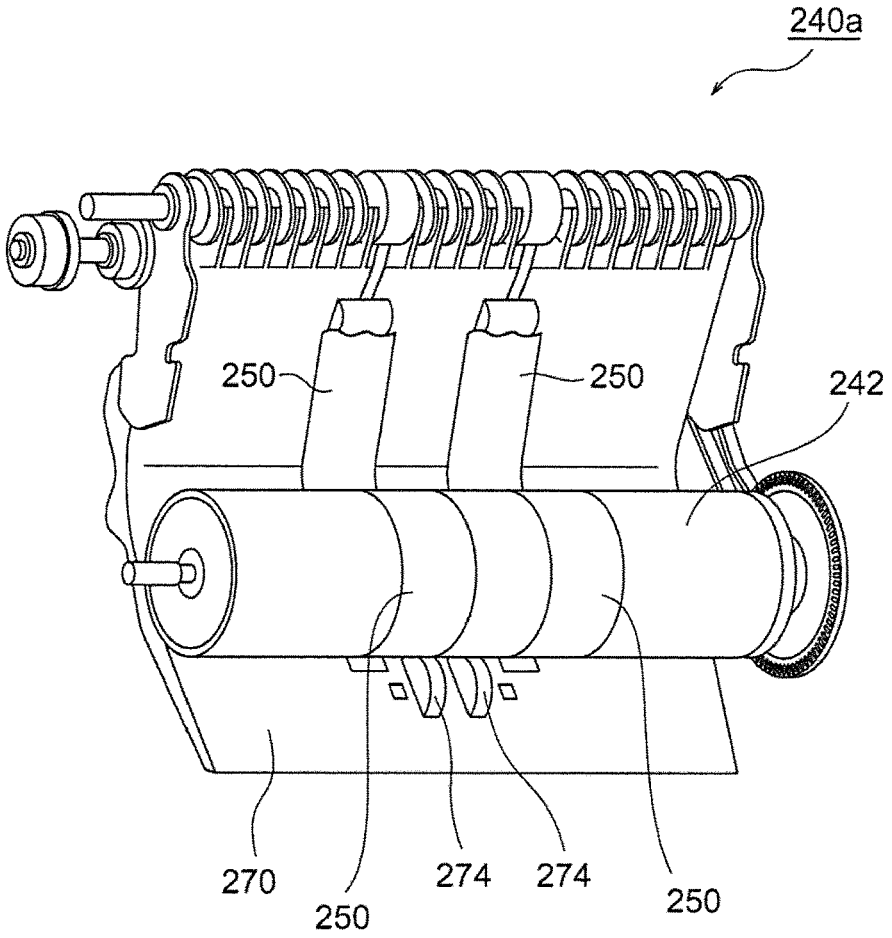
FIG. 31 is a perspective view of the configuration of the paper sheet storing/feeding device shown in FIGS. 29 and 30.

As the tape-type paper sheet storing/feeding device in which the paper sheets such as the banknotes are stored one by one on the rotary member such as the drum and the paper sheets are fed one by one from the rotary member, a device having the configuration shown in FIGS. 26 to 28 can be used. FIGS. 26 and 27 are side views indicating a configuration of a paper sheet storing/feeding device 240 according to yet another variation, and FIG. 28 is a perspective view of the configuration of the paper sheet storing/feeding device 240 shown in FIGS. 26 and 27. Note that, FIG. 26 shows a state in which no tape 250 has been wound on a drum 242, and FIG. 27 shows a state in which the entire tapes 250 unwound from a tape reel 244 are wound on the drum 242. Moreover, FIGS. 29 and 30 are side views indicating a configuration of a conventional paper sheet storing/feeding device 240*a* as a comparative example, and FIG. 31 is a perspective view of the configuration of the paper sheet storing/feeding device 240*a* shown in FIGS. 29 and 30. Note that, FIG. 29 shows a state in which no tape 250 has been wound on the drum 242, and FIG. 30 shows a state in which the entire tapes 250 unwound from the tape reel 244 are wound on the drum 242.

As shown in FIGS. 26 to 28, the paper sheet storing/feeding device 240 includes the rotatable drum 242, the two belt-shaped tapes 250 whose one ends are connected to an outer peripheral surface of the drum 242, and the rotatable tape reel 244 to an outer peripheral surface of which the other ends of the tapes 250 are connected. As shown in FIG. 28, the two tapes 250 are arranged side-by-side in a direction parallel to an axis 242*a* of the drum 242.

The drum 242 can rotate around the axis 242*a* in both a clockwise direction and a counterclockwise direction in FIGS. 26 and 27. Specifically, when storing on the drum 242 the paper sheet sent inside the paper sheet storing/feeding device 240 from a port 258 from the outside of the paper sheet storing/feeding device 240, the drum 242 is rotated in the counterclockwise direction in FIGS. 26 and 27 so that the paper sheet sent near the drum 242 is wound along with the tapes 250 on the drum 242. On the other hand, when feeding the paper sheet stored on the drum 242 to the outside of the paper sheet storing/feeding device 240, the drum 242 is rotated in the clockwise direction in FIGS. 26 and 27 to unwind the tapes 250 from the drum 242 so that the paper sheet is released from the tapes 250 and sent from the port 258 to the outside of the paper sheet storing/feeding device 240.

As shown in FIGS. 26 and 27, guiding rollers 252, 254, 256 that guide the tapes 250 are arranged in the paper sheet storing/feeding device 240. The tapes 250 are guided between the drum 242 and the tape reel 244 by the guiding rollers 252, 254, 256. The guiding roller 254 and the guiding roller 256 are arranged opposite to each other, and the tapes 250 are passed between the guiding roller 254 and the guiding roller 256. Moreover, the paper sheet storing/feeding device 240 is provided with an endless belt 260 that transports the paper sheet, sent from the outside to the inside of the paper sheet storing/feeding device 240 via the port 258, to the near of the drum 242. This endless belt 260 is looped over pulleys 262, 264, 266.

Moreover, as shown in FIGS. 26 and 27, the paper sheet storing/feeding device 240 is provided with a first movable guide 270 in a periphery of the drum 242 (specifically, on the left of the drum 242 in FIGS. 26 and 27). The first movable guide 270 rotates around an axis 271 that is arranged coaxially with an axis of the pulley 266 on which the endless belt 260 has been looped over. Moreover, a biasing unit such as a spring that biases the first movable guide 270 in the counterclockwise direction in FIGS. 26 and 27 around the axis 271 is arranged. Moreover, the first movable guide 270 is provided with a plurality of bearings 274 that push the paper sheet wound on the drum 242 towards the axis 242*a* of the drum 242 (see FIGS. 26 to 28). Because the first movable guide 270 is biased in the counterclockwise direction in FIGS. 26 and 27 around the axis 271 by the biasing unit such as the spring, the bearings 274 are pushed in the right direction in FIGS. 26 and 27, and accordingly, the paper sheet wound on the drum 242 is pushed towards the axis 242*a* of the drum 242 by the bearings 274. Moreover, because the first movable guide 270 is biased in the counterclockwise direction in FIGS. 26 and 27 around the axis 271 by the biasing unit such as the spring, even if the outer diameter of the tapes 250 decreases because the paper sheets wound on the drum 242 are unwound from the drum 242, the bearings 274 always touch the paper sheet and push the paper sheet.

Moreover, as shown in FIGS. 26 and 27, the paper sheet storing/feeding device 240 is provided with a second movable guide 272 above the drum 242 opposite to the first movable guide 270. A small gap is secured between the first movable guide 270 and the second movable guide 272. The guiding roller 254 is arranged at a tip part of the second movable guide 272. The second movable guide 272 is fixed to the first movable guide 270, and the second movable guide 272 rotates in synchronization with the first movable guide 270 around the axis 271. The paper sheet sent inside the paper sheet storing/feeding device 240 from the port 258 from the outside of the paper sheet storing/feeding device 240 is first guided so as to pass through a gap between the endless belt 260 and the second movable guide 272, and then guided so as to pass through the gap between the first movable guide 270 and the second movable guide 272. After the paper sheet is guided so as to pass through the gap between the first movable guide 270 and the second movable guide 272, the paper sheet is wound on the drum 242 by the tapes 250. Moreover, the guiding roller 256 arranged in the first movable guide 270 and the guiding roller 254 arranged in the second movable guide 272 are pushed towards each other, and the paper sheet that should be sent to the drum 242 through the gap between the first movable guide 270 and the second movable guide 272 and/or the paper sheet unwound from the drum 242 passes through a nip formed between the guiding rollers 254 and 256.

In the paper sheet storing/feeding device 240 shown in FIGS. 26 to 28, even if the paper sheet gets folded while the paper sheet is fed from the drum 242 when the drum 242 rotates in the clockwise direction in FIGS. 26 and 27, guiding units 280 are arranged to prevent the folded paper sheet from sandwiching the tapes 250 from both sides. As shown in FIG. 28, the two tapes 250 are arranged side by side in the axial direction of the drum 242, and two guiding units 280, one corresponding to each of the tapes 250, are arranged. More particularly, as shown in FIG. 28, a position of each of the guiding units 280 in the axial direction of the drum 242 (i.e., a position in the left-right direction of FIG. 28) is opposite to the corresponding tapes 250. These guiding units 280 are shown with hatching in FIGS. 26 and 27.

As shown in FIG. 28, the guiding units 280 have a shape such that both the side edges thereof circumferentially extend along the drum 242 with a constant width in the axial direction of the drum 242 (i.e., a width in the left-right direction of FIG. 28) in a direction in which the paper sheet is fed from the drum 242. Moreover, the guiding units 280 are arranged so as to bend towards the drum 242 from a guide surface 270*a* of the first movable guide 270 that guides the paper sheet. A guide surface 280*a* of each of the guiding units 280 is opposed to the corresponding tapes 250 with a small gap with the surface of the tapes 250 that are wound on the drum 242. The first movable guide 270 to which the guiding units 280 have been attached is pivotable around the axis 271 depending on the quantity of the paper sheets stored on the drum 242. Because the first movable guide 270 is pushed by the biasing unit such as the spring in the counterclockwise direction in FIGS. 26 and 27 around the axis 271 so that the bearings 274 arranged in the first movable guide 270 touch the paper sheet wound on the drum 242, irrespective of whether the quantity of the paper sheets stored on the drum 242 is large or small, a small gap is formed between the guide surfaces 280*a* of the guiding units 280 and the surface of the tapes 250 wound on the drum 242. Because the guiding units 280 having such a configuration are arranged opposite to the tapes 250 with a small gap between the surface of the tapes 250, even if a folded part of the paper sheet tries to ride on the surface of the tapes 250 when the paper sheet is fed from the drum 242 while the tapes 250 are unwound from the drum 242, it is inhibited that the folded part rides on the surface of the tapes 250 as the folded part of this paper sheet contacts a side surface of the guiding units 280. Therefore, it is prevented that the folded paper sheet sandwiches the tapes 250 from both sides.

On the other hand, as shown in FIGS. 29 to 31, such guiding units 280 are not arranged in the conventional paper sheet storing/feeding device 240*a* as the comparative example. In this manner, in the conventional paper sheet storing/feeding device 240*a* in which the guiding units 280 are not arranged, when the paper sheet fed from the drum 242 as the tapes 250 are unwound from the drum 242 has a cut part in a front edge of the paper sheet in a feeding direction of the paper sheet, and when a part of the paper sheet gets folded at the cut part, the folded part of the paper sheet may touch a back surface of the tapes 250 and the folded paper sheet may sandwich the tapes 250 from both sides. When this happens, when the paper sheet is released near the guiding roller 252 from the tapes 250, the part of the paper sheet that got folded in the tapes 250 may be sandwiched between the tapes 250 and the guiding roller 252, and the paper sheet may be torn from the cut part or the orientation of the paper sheet may change greatly.

In this manner, the paper sheet storing/feeding device 240 shown in FIGS. 26 to 28, like the escrow unit 40 shown in FIGS. 2 to 15, is provided with the guiding units 280 to guide the paper sheet to prevent the paper sheet from sandwiching the tapes 250 from both sides when the paper sheet is fed from the drum 242 by unwinding the tapes 250 from the drum 242. Because such guiding units 280 are arranged, when the paper sheet is folded while the paper sheet is fed from the drum 242, it is prevented by the guiding units 280 that the folded paper sheet sandwiches the tapes 250 from both sides. Therefore, it is prevented that the paper sheet gets torn or the orientation of the paper sheet changes greatly near the place (specifically, near the guiding roller 252) where the paper sheet is released from the tapes 250.

The invention claimed is:

1. A sheet storing/feeding device comprising:

a rotary member to an outer peripheral surface of which one end of a belt-shaped winding member that winds a plurality of sheets one by one is connected, and on which the sheets are stored when the winding member is wound on the outer peripheral surface thereof and the sheets are fed therefrom when the winding member is unwound from the outer peripheral surface thereof;

a guiding unit that guides a sheet to prevent the sheet from sandwiching the winding member from both sides when the sheet is fed from the rotary member by unwinding the winding member from the rotary member; and a tape reel that winds the winding member, wherein the winding member comprises a plurality of winding members arranged side by side along the axial direction of the rotary member, the guiding unit comprises a plurality of guiding units corresponding to each of the winding members, the tape reel comprises a plurality of tape reels corresponding to each of the winding members, and the one end of each of the winding members is connected to the rotary member and the other end of each of the winding members is connected to the tape reel.

2. The sheet storing/feeding device as claimed in claim 1, wherein the guiding unit is arranged at a position in an axial direction of the rotary member to be facing the winding member.

3. The sheet storing/feeding device as claimed in claim 2, wherein the guiding unit has a shape such that a folded part of the sheet moves away from the winding member in the axial direction of the rotary member when the sheet is fed from the rotary member by unwinding the winding member from the rotary member.

4. The sheet storing/feeding device as claimed in claim 3, wherein the guiding unit has a shape such that a width thereof in the axial direction of the rotary member gradually increases in a direction in which the sheet is fed from the rotary member.

5. The sheet storing/feeding device as claimed in claim 2, wherein the guiding unit has a shape such that both sides thereof circumferentially extend along the rotary member with a constant width in the axial direction of the rotary member in the direction in which the sheet is fed from the rotary member.

6. The sheet storing/feeding device as claimed in claim 1, wherein the guiding unit is arranged on each of two sides of the belt-shaped winding member and opposite to each other.

7. The sheet storing/feeding device as claimed in claim 1, further comprising an additional guiding unit that is pivotable around an axis depending on a quantity of the sheets stored on the rotary member, and that guides the sheet when the sheet is stored on the rotary member by the winding of the winding member on the rotary member, and the guiding unit is attached to the additional guiding unit.

8. The sheet storing/feeding device as claimed in claim 7, wherein the guiding unit is arranged so as to bend towards the rotary member from a guide surface of the additional guiding unit that guides the sheet.

9. The sheet storing/feeding device as claimed in claim 1, wherein the guiding unit is pivotable around an axis depending on a quantity of the sheets stored on the rotary member so as to be able to contact the winding member wound on the rotary member.

10. The sheet storing/feeding device as claimed in claim 1, further comprising a winding member guiding unit that is arranged near a guiding roller that guides the winding member unwound from the rotary member and that contacts the winding member present between the rotary member and the guiding roller, wherein the winding member guiding unit has a shape that attempts to prevent the sheet unwound from the rotary member from entering between the guiding roller and the winding member.

11. The sheet storing/feeding device as claimed in claim 10, wherein the winding member guiding unit has a shape that attempts to prevent the sheet unwound from the rotary member from entering between the winding member guiding unit and the winding member.

12. The sheet storing/feeding device as claimed in claim 10, wherein the winding member guiding unit has a shape such that the winding member guiding unit covers at least one side edge of the winding member that contacts the winding member guiding unit.

13. The sheet storing/feeding device as claimed in claim 10, wherein the winding member guiding unit has a shape such that a cross-section of the winding member changes from a linear shape when the winding member contacts the winding member guiding unit.

* * * * *